US010569121B2

(12) United States Patent
Watterson

(10) Patent No.: US 10,569,121 B2
(45) Date of Patent: Feb. 25, 2020

(54) PULL CABLE RESISTANCE MECHANISM IN A TREADMILL

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 141 days.

(21) Appl. No.: 15/830,271

(22) Filed: Dec. 4, 2017

(65) Prior Publication Data

US 2018/0154205 A1 Jun. 7, 2018

Related U.S. Application Data

(60) Provisional application No. 62/429,977, filed on Dec. 5, 2016.

(51) Int. Cl.
*A63B 22/00* (2006.01)
*A63B 22/02* (2006.01)
(Continued)

(52) U.S. Cl.
CPC .... *A63B 22/0002* (2013.01); *A63B 21/00192* (2013.01); *A63B 21/154* (2013.01); *A63B 21/225* (2013.01); *A63B 21/4035* (2015.10); *A63B 22/025* (2015.10); *A63B 23/03558* (2013.01); *A63B 23/1209* (2013.01); *A63B 24/0062* (2013.01); *A63B 24/0087* (2013.01); *A63B 71/0622* (2013.01); *A63B 2210/50* (2013.01); *A63B 2220/17* (2013.01); *A63B 2220/40* (2013.01); *A63B 2220/51* (2013.01); *A63B 2220/62* (2013.01); *A63B 2220/73* (2013.01); *A63B 2220/80* (2013.01); *A63B 2220/805* (2013.01); *A63B 2220/807* (2013.01); *A63B 2220/833* (2013.01); *A63B 2220/836* (2013.01); *A63B 2220/89* (2013.01);
(Continued)

(58) Field of Classification Search
None
See application file for complete search history.

(56) References Cited

U.S. PATENT DOCUMENTS 3,926,430 A 12/1975 Good, Jr.
4,533,136 A 8/1985 Smith et al.
(Continued)

FOREIGN PATENT DOCUMENTS

CN 2172137 Y 7/1994
CN 2291169 Y 6/1998
(Continued)

OTHER PUBLICATIONS

Written Opinion and International Search Report issued in PCT/US2017/064536 dated Mar. 22, 2018.
(Continued)

*Primary Examiner* — Stephen R Crow
(74) *Attorney, Agent, or Firm* — Maschoff Brennan

(57) ABSTRACT

A treadmill may include a deck, a first pulley disposed in a first portion of the deck, a second pulley disposed in a second portion of the deck, a tread belt surrounding the first pulley and the second pulley, an upright structure connected to the deck, and a pull cable incorporated into the upright structure.

19 Claims, 12 Drawing Sheets

(51) Int. Cl.

| | |
|---|---|
| ***A63B 21/00*** | (2006.01) |
| ***A63B 21/22*** | (2006.01) |
| ***A63B 24/00*** | (2006.01) |
| ***A63B 23/12*** | (2006.01) |
| ***A63B 23/035*** | (2006.01) |
| ***A63B 71/06*** | (2006.01) |

(52) U.S. Cl.

CPC ..... *A63B 2225/10* (2013.01); *A63B 2225/50* (2013.01); *A63B 2230/06* (2013.01); *A63B 2230/207* (2013.01); *A63B 2230/60* (2013.01); *A63B 2230/75* (2013.01)

(56) References Cited

U.S. PATENT DOCUMENTS 4,725,057 A 2/1988 Shifferaw
4,968,028 A 11/1990 Wehrell
5,000,442 A 1/1991 Dalebout et al.
5,039,091 A 8/1991 Johnson
5,280,936 A 1/1994 Schmidlin
5,281,193 A 1/1994 Colbo, Jr.
5,282,776 A 2/1994 Dalebout
5,284,461 A 2/1994 Wilkinson et al.
5,284,463 A 2/1994 Shields
5,284,464 A 2/1994 Lee, III et al.
5,286,243 A 2/1994 Lapcevic
5,290,205 A 3/1994 Densmore et al.
5,290,211 A 3/1994 Stearns
5,290,214 A 3/1994 Chen
5,292,293 A 3/1994 Schumacher
5,292,297 A 3/1994 Hsu
5,295,928 A 3/1994 Rennex
5,295,935 A 3/1994 Wang
5,298,002 A 3/1994 Lin
5,299,810 A 4/1994 Pierce et al.
5,299,992 A 4/1994 Wilkinson
5,299,993 A 4/1994 Habing
5,299,997 A 4/1994 Chen
5,301,154 A 4/1994 Suga
5,302,161 A 4/1994 Loubert et al.
5,302,162 A 4/1994 Pasero
5,303,885 A 4/1994 Wade
5,306,218 A 4/1994 Huang Chen
5,306,220 A 4/1994 Kearney
5,306,221 A 4/1994 Itaru
5,308,075 A 5/1994 Theriault
5,308,234 A 5/1994 Nicke et al.
5,308,296 A 5/1994 Eckstein
5,308,300 A 5/1994 Chino et al.
5,308,304 A 5/1994 Habing
5,309,355 A 5/1994 Lockwood
5,310,392 A 5/1994 Lo
5,310,394 A 5/1994 Kallios
5,313,852 A 5/1994 Arena
5,313,942 A 5/1994 Platzker
5,314,389 A 5/1994 Dotan
5,314,390 A 5/1994 Westing et al.
5,314,391 A 5/1994 Potash et al.
5,314,392 A 5/1994 Hawkins et al.
5,314,394 A 5/1994 Ronan
5,316,534 A 5/1994 Dalebout et al.
5,318,487 A 6/1994 Golen et al.
5,318,490 A 6/1994 Henderson et al.
5,318,495 A 6/1994 Malynowsky
5,320,343 A 6/1994 McKinney
5,320,588 A 6/1994 Wanzer et al.
5,320,591 A 6/1994 Harmon et al.
5,322,489 A 6/1994 Webb et al.
5,323,650 A 6/1994 Fullen et al.
5,323,784 A 6/1994 Shu
5,324,242 A 6/1994 Lo
5,328,410 A 7/1994 Amburgey et al.
5,328,420 A 7/1994 Allen
5,328,422 A 7/1994 Nichols
5,328,428 A 7/1994 Huang
5,328,429 A 7/1994 Potash et al.
5,328,430 A 7/1994 Vittone
5,330,401 A 7/1994 Walstead
5,330,402 A 7/1994 Johnson
5,330,404 A 7/1994 Lopeteguy et al.
5,330,405 A 7/1994 Habing et al.
5,330,408 A 7/1994 Westmoreland, Jr.
5,334,120 A 8/1994 Rasmussen
5,335,188 A 8/1994 Brisson
5,336,142 A 8/1994 Dalebout et al.
5,336,143 A 8/1994 Wu
5,336,144 A 8/1994 Rodden
5,336,145 A 8/1994 Keiser
5,336,146 A 8/1994 Piaget et al.
5,336,148 A 8/1994 Ish, III
5,336,151 A 8/1994 Van Ballegooie
5,338,274 A 8/1994 Jones
5,338,277 A 8/1994 Yang
5,342,261 A 8/1994 Johnston
5,342,264 A 8/1994 Gordon
5,342,269 A 8/1994 Huang
5,342,271 A 8/1994 Long
5,344,372 A 9/1994 Hung
5,344,374 A 9/1994 Telle
5,344,376 A 9/1994 Bostic et al.
5,346,447 A 9/1994 Shew
5,348,524 A 9/1994 Grant
5,350,344 A 9/1994 Kissel
5,350,345 A 9/1994 Frey
5,352,166 A 10/1994 Chang
5,352,167 A 10/1994 Ulicny
5,352,169 A 10/1994 Eschenbach
5,352,171 A 10/1994 Lin
5,352,174 A 10/1994 Mason et al.
5,353,452 A 10/1994 Rulis
5,354,248 A 10/1994 Rawls et al.
5,354,251 A 10/1994 Sleamaker
5,354,252 A 10/1994 Habing
5,354,253 A 10/1994 Awbrey et al.
5,356,003 A 10/1994 Gretz et al.
5,356,356 A 10/1994 Hildebrandt et al.
5,356,357 A 10/1994 Wang et al.
5,356,358 A 10/1994 Chen
5,356,360 A 10/1994 Johns
5,357,696 A 10/1994 Gray
5,358,461 A 10/1994 Bailey, Jr.
5,358,462 A 10/1994 Calderone
D352,536 S 11/1994 Byrd et al.
5,359,986 A 11/1994 Magrath, III et al.
5,361,091 A 11/1994 Hoarty et al.
5,361,778 A 11/1994 Seitz
5,362,069 A 11/1994 Hall-Tipping
5,362,290 A 11/1994 Huang
5,362,295 A 11/1994 Nurge
5,362,296 A 11/1994 Wang et al.
5,362,298 A 11/1994 Brown et al.
5,364,060 A 11/1994 Donovan et al.
5,364,271 A 11/1994 Aknin et al.
5,364,327 A 11/1994 Graham
5,366,428 A 11/1994 Liao
5,366,432 A 11/1994 Habing et al.
5,368,042 A 11/1994 O'Neal et al.
5,368,532 A 11/1994 Farnet
5,368,536 A 11/1994 Stodgell
5,370,594 A 12/1994 Grinblat
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,374,230 A 12/1994 Bonnaime
5,375,068 A 12/1994 Palmer et al.
5,376,053 A 12/1994 Ponder
5,377,171 A 12/1994 Schlup
5,377,258 A 12/1994 Bro
5,378,212 A 1/1995 Pin-Kuo
5,378,216 A 1/1995 Ish, III et al.
5,380,258 A 1/1995 Hawley, Jr.

(56) References Cited

U.S. PATENT DOCUMENTS 5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,385,520 A 1/1995 Lepine et al.
5,387,164 A 2/1995 Brown, Jr.
5,387,169 A 2/1995 Wang
5,387,170 A 2/1995 Rawls et al.
5,387,171 A 2/1995 Casey et al.
5,391,080 A 2/1995 Bernacki
5,391,132 A 2/1995 Greenwald
5,392,476 A 2/1995 Williams
5,394,922 A 3/1995 Colson et al.
5,396,340 A 3/1995 Ishii et al.
5,396,876 A 3/1995 Liscio et al.
5,397,287 A 3/1995 Lindfors
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,403,256 A 4/1995 Squires
5,406,661 A 4/1995 Pekar
5,407,402 A 4/1995 Brown et al.
5,407,403 A 4/1995 Coleman
5,407,404 A 4/1995 Killian et al.
5,407,405 A 4/1995 Oren
5,407,408 A 4/1995 Wilkinson
5,407,411 A 4/1995 Trainor
5,407,414 A 4/1995 Bass
5,409,330 A 4/1995 Naines et al.
5,409,435 A * 4/1995 Daniels ..... A63B 21/0056
482/5
5,410,471 A 4/1995 Alyfuku et al.
5,410,472 A 4/1995 Anderson
5,410,971 A 5/1995 Golden et al.
5,413,546 A 5/1995 Basile
5,413,551 A 5/1995 Wu
5,415,608 A 5/1995 Bode
5,417,222 A 5/1995 Dempsey et al.
5,417,634 A 5/1995 Habing
5,417,643 A 5/1995 Taylor
5,419,562 A 5/1995 Cromarty
5,419,570 A 5/1995 Bollotte
5,419,571 A 5/1995 Vaughan
5,419,747 A 5/1995 Piaget
5,419,749 A 5/1995 Morgenstein
5,419,751 A 5/1995 Byrd et al.
5,421,795 A 6/1995 Chen
5,421,796 A 6/1995 Jones et al.
5,421,798 A 6/1995 Bond et al.
5,421,800 A 6/1995 Mullen
5,421,801 A 6/1995 Davies, III et al.
5,423,729 A 6/1995 Eschenbach
5,423,730 A 6/1995 Hirsch
5,423,731 A 6/1995 Chen
5,429,563 A 7/1995 Engel et al.
5,429,567 A 7/1995 Gerschefske et al.
5,429,568 A 7/1995 Chen
5,429,569 A 7/1995 Gunnari
5,431,612 A 7/1995 Holden
5,433,679 A 7/1995 Szymczak et al.
5,433,685 A 7/1995 Winslow
5,435,315 A 7/1995 McPhee et al.
5,435,798 A 7/1995 Habing et al.
5,435,799 A 7/1995 Lundin
5,435,801 A 7/1995 Hung
5,437,289 A 8/1995 Liverance
5,437,589 A 8/1995 Habing
5,439,225 A 8/1995 Gvoich et al.
5,441,467 A 8/1995 Stevens
5,441,468 A 8/1995 Deckers et al.
5,443,435 A 8/1995 Wilkinson
5,445,583 A 8/1995 Habing
5,447,480 A 9/1995 Fulks
5,449,332 A 9/1995 Hervig
5,449,334 A 9/1995 Kingsbury
5,451,191 A 9/1995 Beenken
5,451,922 A 9/1995 Hamilton
5,452,269 A 9/1995 Cherdak
5,453,066 A 9/1995 Richter, Jr.
5,454,772 A 10/1995 Rodden
5,454,773 A 10/1995 Blanchard et al.
5,456,262 A 10/1995 Birnbaum
5,456,644 A 10/1995 Hecox et al.
5,456,648 A 10/1995 Edinburg
5,458,553 A 10/1995 Wu
5,460,586 A 10/1995 Wilkinson
5,462,051 A 10/1995 Oka et al.
5,462,503 A 10/1995 Benjamin et al.
5,462,504 A 10/1995 Trulaske et al.
5,464,378 A 11/1995 Lee
5,466,200 A 11/1995 Ulrich et al.
5,466,203 A 11/1995 Chen
5,467,874 A 11/1995 Whitaker
5,468,205 A 11/1995 McFall et al.
5,469,740 A 11/1995 French et al.
5,470,298 A 11/1995 Curtis
5,471,405 A 11/1995 Marsh
5,472,205 A 12/1995 Bouton
5,472,397 A 12/1995 Ammoscato et al.
5,472,399 A 12/1995 Szekely
5,474,077 A 12/1995 Suga
5,474,087 A 12/1995 Nashner
5,474,090 A 12/1995 Begun et al.
5,474,510 A 12/1995 Chen
5,476,428 A 12/1995 Potash et al.
5,476,430 A 12/1995 Lee et al.
5,478,295 A 12/1995 Fracchia
5,478,298 A 12/1995 Chen
5,480,212 A 1/1996 Marconet
5,482,472 A 1/1996 Garoni et al.
5,484,358 A 1/1996 Wang et al.
5,484,362 A 1/1996 Skowronski et al.
5,484,365 A 1/1996 Jones et al.
5,484,389 A 1/1996 Stark
5,486,001 A 1/1996 Baker
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,518 A 2/1996 Measom
5,492,520 A 2/1996 Brown
5,493,127 A 2/1996 Lloyd et al.
5,496,235 A 3/1996 Stevens
5,496,236 A 3/1996 Buonauito
5,496,238 A 3/1996 Taylor
5,496,239 A 3/1996 Kallman
5,496,244 A 3/1996 Caruthers
5,498,222 A 3/1996 Hur
5,498,223 A 3/1996 Iams et al.
5,499,956 A 3/1996 Habing et al.
5,499,959 A 3/1996 Holmes et al.
5,499,961 A 3/1996 Mattox
5,501,647 A 3/1996 Snyder
5,501,656 A 3/1996 Homma et al.
5,503,608 A 4/1996 Chang
5,505,011 A 4/1996 Bleimhofer
5,505,677 A 4/1996 Hinds
5,507,271 A 4/1996 Actor
5,507,710 A 4/1996 Chen
5,509,870 A 4/1996 Lloyd
5,510,828 A 4/1996 Lutterbach
5,512,025 A 4/1996 Dalebout et al.
5,512,029 A 4/1996 Barnard
5,514,053 A 5/1996 Hawkins et al.
5,514,059 A 5/1996 Romney
5,516,334 A 5/1996 Easton

(56) References Cited

U.S. PATENT DOCUMENTS 5,518,471 A 5/1996 Hettinger et al.
5,518,473 A 5/1996 Miller
5,518,476 A 5/1996 Mcleon
5,518,477 A 5/1996 Simonson
5,518,483 A 5/1996 Oswald
5,518,486 A 5/1996 Sheeler
5,519,189 A 5/1996 Gibisch
5,520,599 A 5/1996 Chen
5,522,783 A 6/1996 Gordon
5,524,110 A 6/1996 Danneels et al.
5,524,637 A 6/1996 Erickson
5,527,239 A 6/1996 Abbondanza
5,527,245 A 6/1996 Dalebout et al.
5,527,249 A 6/1996 Harris
5,527,250 A 6/1996 Chen
5,527,253 A 6/1996 Wilkinson
5,529,554 A 6/1996 Eschenbach
5,529,560 A 6/1996 Dise
5,531,658 A 7/1996 L. S. C.
5,533,899 A 7/1996 Young
5,533,948 A 7/1996 Wilkinson
5,533,951 A 7/1996 Chang
5,533,952 A 7/1996 Schaber
5,535,664 A 7/1996 Rokowski
5,538,486 A 7/1996 France et al.
5,538,489 A 7/1996 Magid
5,540,642 A 7/1996 Sprague
5,542,420 A 8/1996 Goldman
5,542,672 A 8/1996 Meredith
5,542,892 A 8/1996 Buhler
5,545,112 A 8/1996 Densmore et al.
5,545,114 A 8/1996 Gvoich
5,547,439 A 8/1996 Rawls et al.
5,549,052 A 8/1996 Hoffman
5,549,530 A 8/1996 Fulks
5,549,532 A 8/1996 Kropp
5,549,533 A 8/1996 Olson et al.
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,554,085 A 9/1996 Dalebout
5,554,086 A 9/1996 Habing et al.
5,556,362 A 9/1996 Whipps
5,556,369 A 9/1996 Roberts
5,558,608 A 9/1996 Hall
5,562,572 A 10/1996 Carmein
5,562,574 A 10/1996 Miller
5,562,577 A 10/1996 Nichols, Sr. et al.
5,563,487 A 10/1996 Davis
5,568,993 A 10/1996 Potzick
5,569,120 A 10/1996 Anjanappa et al.
5,569,128 A 10/1996 Dalebout
5,569,133 A 10/1996 Vittone
5,569,138 A 10/1996 Wang et al.
5,571,064 A 11/1996 Holm
5,572,643 A 11/1996 Judson
5,573,485 A 11/1996 Geschwender
5,575,740 A 11/1996 Piaget
5,576,951 A 11/1996 Lockwood
5,577,186 A 11/1996 Mann, II et al.
5,577,981 A 11/1996 Jarvik
5,588,938 A 12/1996 Schnider et al.
5,830,113 A 11/1998 Coody et al.
6,027,429 A 2/2000 Daniels
6,030,320 A 2/2000 Stearns et al.
6,030,321 A 2/2000 Fuentes
6,123,649 A 9/2000 Lee et al.
D457,580 S 5/2002 Webber
6,454,679 B1 9/2002 Radow
6,491,610 B1 12/2002 Henn
6,699,159 B2 3/2004 Rouse
6,746,371 B1 6/2004 Brown et al.
6,837,830 B2 1/2005 Eldridge
6,857,993 B2 2/2005 Yeh
6,958,032 B1 * 10/2005 Smith ..... A63B 21/023 482/121
D511,190 S 11/2005 Panatta
D512,113 S 11/2005 Carter
7,011,326 B1 3/2006 Schroeder et al.
D520,085 S 5/2006 Willardson et al.
7,226,402 B1 6/2007 Joya
D552,193 S 10/2007 Husted et al.
7,364,538 B2 4/2008 Aucamp
7,540,828 B2 6/2009 Watterson et al.
7,575,537 B2 8/2009 Ellis
7,584,673 B2 9/2009 Shimizu
7,641,597 B2 * 1/2010 Schmidt ..... A63B 21/0058 482/4
7,740,563 B2 6/2010 Dalebout et al.
D633,581 S 3/2011 Thulin
7,942,793 B2 5/2011 Mills et al.
8,096,926 B1 1/2012 Batca
8,398,529 B2 * 3/2013 Ellis ..... A63B 21/155 482/124
8,500,607 B2 8/2013 Vittone et al.
8,550,964 B2 10/2013 Ish, III et al.
8,764,609 B1 7/2014 Elahmadie
8,808,152 B1 8/2014 Midgett
9,011,291 B2 4/2015 Birrell
D746,388 S 12/2015 Hockridge
9,211,433 B2 12/2015 Hall
9,254,409 B2 2/2016 Dalebout et al.
9,393,453 B2 7/2016 Watterson
9,403,047 B2 8/2016 Olson et al.
9,415,257 B2 8/2016 Habing
9,539,458 B1 1/2017 Ross
9,616,276 B2 4/2017 Dalebout et al.
9,662,529 B2 5/2017 Miller et al.
9,700,751 B2 * 7/2017 Verdi ..... A63B 21/4019
9,757,605 B2 9/2017 Olson et al.
D807,445 S 1/2018 Gettle
9,878,200 B2 1/2018 Edmondson
9,968,816 B2 5/2018 Olson et al.
10,188,890 B2 * 1/2019 Olson ..... A63B 21/00192
10,279,212 B2 5/2019 Dalebout et al.
10,293,211 B2 * 5/2019 Watterson ..... A63B 21/0726
10,426,989 B2 10/2019 Dalebout
2002/0013200 A1 1/2002 Sechrest
2002/0025888 A1 2/2002 Germanton
2002/0086779 A1 7/2002 Wilkinson
2003/0032528 A1 2/2003 Wu et al.
2003/0032531 A1 2/2003 Simonson
2003/0032535 A1 2/2003 Wang et al.
2003/0045406 A1 3/2003 Stone
2003/0176261 A1 9/2003 Simonson et al.
2003/0181293 A1 9/2003 Baatz
2004/0043873 A1 3/2004 Wilkinson et al.
2004/0102292 A1 5/2004 Pyles et al.
2004/0176227 A1 9/2004 Endelman
2005/0049117 A1 3/2005 Rodgers
2005/0130814 A1 6/2005 Nitta et al.
2005/0148445 A1 7/2005 Carle
2005/0164837 A1 7/2005 Anderson et al.
2006/0035755 A1 2/2006 Dalebout et al.
2006/0148622 A1 7/2006 Chen
2006/0240955 A1 10/2006 Pu
2006/0252613 A1 11/2006 Barnes et al.
2007/0123395 A1 5/2007 Ellis
2007/0173392 A1 7/2007 Stanford
2007/0197346 A1 8/2007 Seliber
2007/0232463 A1 10/2007 Wu
2007/0287601 A1 12/2007 Burch et al.
2008/0051256 A1 2/2008 Ashby et al.
2008/0119337 A1 5/2008 Wilkins et al.
2009/0036276 A1 2/2009 Loach
2010/0197462 A1 8/2010 Piane, Jr.
2010/0255965 A1 10/2010 Chen
2011/0009249 A1 1/2011 Campanaro et al.
2011/0082013 A1 4/2011 Bastian
2012/0065034 A1 3/2012 Loach
2012/0088638 A1 4/2012 Lull
2012/0277068 A1 11/2012 Zhou et al.

(56) References Cited

U.S. PATENT DOCUMENTS

| | | | | |
|---|---|---|---|---|
| 2013/0065732 | A1 | 3/2013 | Hopp | |
| 2013/0090216 | A1 | 4/2013 | Jackson | |
| 2013/0109543 | A1 | 5/2013 | Reyes | |
| 2013/0123073 | A1 | 5/2013 | Olson et al. | |
| 2013/0196821 | A1 | 8/2013 | Watterson et al. | |
| 2013/0303334 | A1* | 11/2013 | Adhami | A63B 21/025 482/4 |
| 2013/0337981 | A1 | 12/2013 | Habing | |
| 2014/0187389 | A1 | 7/2014 | Berg | |
| 2014/0235409 | A1 | 8/2014 | Salmon et al. | |
| 2014/0357457 | A1 | 12/2014 | Boekema | |
| 2014/0371035 | A1 | 12/2014 | Mortensen et al. | |
| 2015/0038300 | A1 | 2/2015 | Forhan et al. | |
| 2015/0182779 | A1* | 7/2015 | Dalebout | A63B 21/152 403/327 |
| 2015/0352396 | A1* | 12/2015 | Dalebout | A63B 21/0442 482/54 |
| 2017/0266481 | A1 | 9/2017 | Dalebout | |
| 2018/0154205 | A1 | 6/2018 | Watterson | |
| 2018/0154209 | A1 | 6/2018 | Watterson | |
| 2019/0151698 | A1 | 5/2019 | Olson et al. | |
| 2019/0269958 | A1 | 9/2019 | Dalebout et al. | |

FOREIGN PATENT DOCUMENTS

| | | | |
|---|---|---|---|
| CN | 101784308 | | 11/2001 |
| CN | 1658929 | | 8/2005 |
| CN | 1708333 | | 12/2005 |
| CN | 2841072 | Y | 11/2006 |
| CN | 201516258 | | 6/2010 |
| CN | 201410258 | Y | 2/2014 |
| CN | 103801048 | | 5/2014 |
| CN | 10488413 | | 9/2015 |
| CN | 105848733 | | 8/2016 |
| CN | 104884133 | B | 2/2018 |
| CN | 106470739 | B | 6/2019 |
| CN | 110035801 | | 7/2019 |
| EP | 1188460 | | 3/2002 |
| EP | 2969058 | | 1/2016 |
| EP | 3086865 | A1 | 11/2016 |
| JP | 2013543749 | | 12/2013 |
| SU | 1533710 | | 1/1990 |
| TW | M464203 | | 11/2013 |
| TW | 201821129 | A | 6/2018 |
| TW | 201821130 | A | 6/2018 |
| TW | 201601802 | A | 12/2018 |
| WO | 1989002217 | | 3/1989 |
| WO | 1997006859 | | 2/1997 |
| WO | 2002053234 | A1 | 7/2002 |
| WO | 2007015096 | A3 | 2/2007 |
| WO | 2014153158 | | 9/2014 |
| WO | 2015/100429 | | 7/2015 |
| WO | 2015191445 | | 12/2015 |
| WO | 2018106598 | | 6/2018 |
| WO | 2018106603 | | 6/2018 |

OTHER PUBLICATIONS

U.S. Appl. No. 61/920,834, filed Dec. 26, 2013, titled "Magnetic Resistance Mechanism in a Cable Machine", 31 pages.

Exxentric, Movie Archives, obtained from The Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *ICON Health & Fitness, Inc.*, Civil Case No. IPR2017-01363, Petition for *Inter Partes* Review of U.S. Pat. No. 9,403,047, filed May 5, 2017; 76 pages (paper 2).

*Nautilus, Inc.* v. *ICON Health & Fitness, Inc.*, Civil Case No. IPR2017-01363, Olson, U.S. Pat. No. 9,403,047, 16 pages, (Petition EX. 1001).

*Nautilus, Inc.* v. *ICON Health & Fitness, Inc.*, Civil Case No. IPR2017-01363, Sleamaker, U.S. Pat. No. 5,354,251, 14 pages, (Petition EX. 1002).

*Nautilus, Inc.* v. *ICON Health & Fitness, Inc.*, Civil Case No. IPR2017-01363, Hanoun, U.S. Publication No. 2007-0232452, 28 pages, (Petition EX. 1003).

*Nautilus, Inc.* v. *ICON Health & Fitness, Inc.*, Civil Case No. IPR2017-01363, Six-Pak, Printed Publication TuffStuff Fitness Six-Pak Trainer Owner's Manual, 19 pages, (Petition EX 1004).

*Nautilus, Inc.* v. *ICON Health & Fitness, Inc.*, Civil Case No. IPR2017-01363, Ehrenfried, U.S. Pat. No. 5,738,611, 19 pages, (Petition EX. 1005).

*Nautilus, Inc.* v. *ICON Health & Fitness, Inc.*, Civil Case No. IPR2017-01363, Kleinman, International Publication No. WO2008/152627, 65 pages, (Petition EX. 1006).

*Nautilus, Inc.* v. *ICON Health & Fitness, Inc.*, Civil Case No. IPR2017-01363, Declaration of Lee Rawls, (Petition EX. 1007).

*Nautilus, Inc.* v. *ICON Health & Fitness, Inc.*, Civil Case No. IPR2017-01363, U.S. Pat. No. 9,403,047 File history, 130 pages, (Petition EX. 1008).

*Nautilus, Inc.* v. *ICON Health & Fitness, Inc.*, Civil Case No. IPR2017-01363, U.S. Appl. No. 61/920,834, 38 pages, (Petition EX. 1009).

*Nautilus, Inc.* v. *ICON Health & Fitness, Inc.*, Civil Case No. IPR2017-01363, Declaration of Christopher Butler, 26 pages, (Petition EX. 1010).

*Nautilus, Inc.* v. *ICON Health & Fitness, Inc.*, Civil Case No. IPR2017-01363, Petitioner's Power of Attorney, filed May 5, 2017, 2 pages (paper 2).

*Nautilus, Inc.* v. *ICON Health & Fitness, Inc.*, Civil Case No. IPR2017-01363, Mandatory Notice to Patent Owner, filed May 19, 2017, 4 pages (paper 3).

*Nautilus, Inc.* v. *ICON Health & Fitness, Inc.*, Civil Case No. IPR2017-01363, Power of Attorney, filed May 19, 2017, 3 pages (paper 4).

*Nautilus, Inc.* v. *ICON Health & Fitness, Inc.*, Civil Case No. IPR2017-01363, Notice of Accord Filing Date, filed Jun. 9, 2017, 5 pages (paper 5).

U.S. Appl. No. 61/786,007, filed Mar. 14, 2013, titled "Strength Training Apparatus with Flywheel and Related Methods", 28 pages.

U.S. Appl. No. 62/009,607, filed Jun. 9, 2014, titled "Cable System Incorporated into a Treadmill", 32 pages.

International Search Report & Written Opinion for PCT Application No. PCT/US2014/029353, dated Aug. 4, 2014, 9 pages.

Supplemental European Search Report for European Application No. 14768130, dated Oct. 11, 2016, 9 pages.

U.S. Appl. No. 15/472,954, filed Mar. 29, 2017, titled "Strength Training Apparatus with Flywheel and Related Methods", 22 pages.

U.S. Appl. No. 15/976,496, filed May 10, 2018, titled "Magnetic Resistance Mechanism in a Cable Machine", 36 pages.

*Nautilus, Inc.* v. *ICON Health & Fitness, Inc.*, Civil Case No. IPR2017-01407, Petition for *Inter Partes* Review of U.S. Pat. No. 9,616,276 (Claims 1-4, 7-10), filed May 5, 2017.

*Nautilus, Inc.* v. *ICON Health & Fitness, Inc.*, Civil Case No. IPR2017-01407, Dalebout et al., U.S. Pat. No. 9,616,276, (Petition EX. 1001).

*Nautilus, Inc.* v. *ICON Health & Fitness, Inc.*, Civil Case No. IPR2017-01407, Wu, U.S. Publication No. 20030171192, (Petition EX. 1002).

*Nautilus, Inc.* v. *ICON Health & Fitness, Inc.*, Civil Case No. IPR2017-01407, Webb, U.S. Publication No. 20030017918, (Petition EX. 1003).

*Nautilus, Inc.* v. *ICON Health & Fitness, Inc.*, Civil Case No. IPR2017-01407, Watson, U.S. Publication No. 20060234840, (Petition EX. 1004).

*Nautilus, Inc.* v. *ICON Health & Fitness, Inc.*, Civil Case No. IPR2017-01407, Jones, U.S. Pat. No. 4,798,378, (Petition EX. 1005).

*Nautilus, Inc.* v. *ICON Health & Fitness, Inc.*, Civil Case No. IPR2017-01407, Zhou et al., U.S. Pat. No. 8,517,899, (Petition EX. 1006).

(56) References Cited

OTHER PUBLICATIONS

*Nautilus, Inc.* v. *ICON Health & Fitness, Inc.*, Civil Case No. IPR2017-01407, Loach, U.S. Publication No. WO2007015096, (Petition EX. 1007).
*Nautilus, Inc.* v. *ICON Health & Fitness, Inc.*, Civil Case No. IPR2017-01407, Rawls Declaration, Part 1 & 2, (Petition EX. 1008).
*Nautilus, Inc.* v. *ICON Health & Fitness, Inc.*, Civil Case No. IPR2017-01407, U.S. Pat. No. 9,616,276 File History, (Petition EX. 1009).
*Nautilus, Inc.* v. *ICON Health & Fitness, Inc.*, Civil Case No. IPR2017-01407, U.S. Appl. No. 61/786,007 File History, (Petition EX. 1010).
*Nautilus, Inc.* v. *ICON Health & Fitness, Inc.*, Civil Case No. IPR2017-01407, Sawicky, U.S. Pat. No. 5,042,798, (Petition EX. 1011).
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01408, Petition for *Inter Partes* Review of U.S. Pat. No. 9,616,276 (Claims 1-20) filed May 5, 2017.
*Nautilus, Inc.* v. *ICON Health & Fitness, Inc.*, Civil Case No. IPR2017-01408, Dalebout et al., U.S. Pat. No. 9,616,276, (Petition EX. 1001).
*Nautilus, Inc.* v. *ICON Health & Fitness, Inc.*, Civil Case No. IPR2017-01408, Wu, U.S. Publication No. 20030171192, (Petition EX. 1002).
*Nautilus, Inc.* v. *ICON Health & Fitness, Inc.*, Civil Case No. IPR2017-01408, Webb, U.S. Publication No. 20030017918, (Petition EX. 1003).
*Nautilus, Inc.* v. *ICON Health & Fitness, Inc.*, Civil Case No. IPR2017-01408, Watson, U.S. Publication No. 20060234840, (Petition EX. 1004).
*Nautilus, Inc.* v. *ICON Health & Fitness, Inc.*, Civil Case No. IPR2017-01408, Jones, U.S. Pat. No. 4,798,378, (Petition X. 1005).
*Nautilus, Inc.* v. *ICON Health & Fitness, Inc.*, Civil Case No. IPR2017-01408, Zhou et al., U.S. Pat. No. 8,517,899, (Petition EX. 1006).
*Nautilus, Inc.* v. *ICON Health & Fitness, Inc.*, Civil Case No. IPR2017-01408, Loach, U.S. Publication No. WO2007015096, (Petition EX. 1007).
*Nautilus, Inc.* v. *ICON Health & Fitness, Inc.*, Civil Case No. IPR2017-01408, Rawls Declaration, Part 1 & 2, (Petition EX. 1008).
*Nautilus, Inc.* v. *ICON Health & Fitness, Inc.*, Civil Case No. IPR2017-01408, U.S. Pat. No. 9,616,276 File History, (Petition EX. 1009).
*Nautilus, Inc.* v. *ICON Health & Fitness, Inc.*, Civil Case No. IPR2017-01408, U.S. Appl. No. 61/786,007 File History, (Petition EX. 1010).
*Nautilus, Inc.* v. *ICON Health & Fitness, Inc.*, Civil Case No. IPR2017-01408, Sawicky, U.S. Pat. No. 5,042,798, (Petition EX. 1011).
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *ICON Health & Fitness, Inc.*, Civil Case No. IPR2017-01363, Declaration of Tyson Hottinger in Support of Motion for Admission Pro Hac Vice, filed Feb. 1, 2018 (Ex 2001).
*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of *Inter Partes* Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).
*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, Order Conduct of Proceedings 37 C.F.R. Sec 42.5, filed Apr. 27, 2018 (Paper 18).
*Nautilus, Inc.* v. *ICON Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01407, Declaration of Tyson Hottinger in Support of Motion for Admission Pro Hac Vice, (Patent Owner EX. 2001).
*Nautilus, Inc.* v. *ICON Health & Fitness, Inc.*, Civil Case No. IPR2017-01407, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01407, Specification of U.S. Pat. No. 9,616,276, (Patent Owner EX. 2003).
*Nautilus, Inc.* v. *ICON Health & Fitness, Inc.*, Civil Case No. IPR2017-01407, Drawings of U.S. Pat. No. 9,616,276, (Patent Owner EX. 2004).
*Nautilus, Inc.* v. *ICON Health & Fitness, Inc.*, Civil Case No. IPR2017-01407, Specification of U.S. Pat. No. 9,254,409 (Patent Owner EX. 2005).
*Nautilus, Inc.* v. *ICON Health & Fitness, Inc.*, Civil Case No. IPR2017-01407, Drawings of U.S. Pat. No. 9,254,409 (Patent Owner EX. 2006).

(56) References Cited

OTHER PUBLICATIONS

*Nautilus, Inc.* v. *ICON Health & Fitness, Inc.*, Civil Case No. IPR2017-01407, Specification of U.S. Appl. No. 61/786,007, (Patent Owner EX. 2007).
*Nautilus, Inc.* v. *ICON Health & Fitness, Inc.*, Civil Case No. IPR2017-01407, Drawings of U.S. Appl. No. 61/786,007, (Patent Owner EX. 2008).
*Nautilus, Inc.* v. *ICON Health & Fitness, Inc.*, Civil Case No. IPR2017-01407, Specification of U.S. Appl. No. 13/754,361 (Patent Owner EX. 2009).
*Nautilus, Inc.* v. *ICON Health & Fitness, Inc.*, Civil Case No. IPR2017-01407, Drawings of U.S. Appl. No. 13/754,361 (Patent Owner EX. 2010).
*Nautilus, Inc.* v. *ICON Health & Fitness, Inc.*, Civil Case No. IPR2017-01407, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of *Inter Partes* Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, Order Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for Pro Hac Vice Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for Pro Hac Vice Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, Order Conduct of Proceedings, filed Apr. 27, 2018 (Paper 19).
*Nautilus, Inc.* v. *ICON Health & Fitness, Inc.*, Civil Case No. IPR2017-01408, Order Conduct of Proceedings, filed May 7, 2018 (Paper 20).
*Nautilus, Inc.* v. *ICON Health & Fitness, Inc.*, Civil Case No. IPR2017-01408, Declaration of Tyson Hottinger in Support of Motion for Admission Pro Hac Vice, (Patent Owner EX. 2001).
*Nautilus, Inc.* v. *ICON Health & Fitness, Inc.*, Civil Case No. IPR2017-01408, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01408, Specification of U.S. Appl. No. 15/019,088, (Patent Owner EX. 2003).
*Nautilus, Inc.* v. *ICON Health & Fitness, Inc.*, Civil Case No. IPR2017-01408, Drawings of U.S. Appl. No. 15/019,088, (Patent Owner EX. 2004).
*Nautilus, Inc.* v. *ICON Health & Fitness, Inc.*, Civil Case No. IPR2017-01408, Specification of U.S. Appl. No. 14/213,793, (Patent Owner EX. 2005).
*Nautilus, Inc.* v. *ICON Health & Fitness, Inc.*, Civil Case No. IPR2017-01408, Drawings of U.S. Appl. No. 14/213,793, (Patent Owner EX. 2006).
*Nautilus, Inc.* v. *ICON Health & Fitness, Inc.*, Civil Case No. IPR2017-01408, Specification of U.S. Appl. No. 61/786,007, (Patent Owner EX. 2007).
*Nautilus, Inc.* v. *ICON Health & Fitness, Inc.*, Civil Case No. IPR2017-01408, Drawings of U.S. Appl. No. 61/786,007, (Patent Owner EX. 2008).
*Nautilus, Inc.* v. *ICON Health & Fitness, Inc.*, Civil Case No. IPR2017-01408, Specification of U.S. Appl. No. 13/754,361, (Patent Owner EX. 2009).
*Nautilus, Inc.* v. *ICON Health & Fitness, Inc.*, Civil Case No. IPR2017-01408, Drawings of U.S. Appl. No. 13/754,361, (Patent Owner EX. 2010).
*Nautilus, Inc.* v. *ICON Health & Fitness, Inc.*, Civil Case No. IPR2017-01408, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01363, Petitioner's Reply in Support of Petition for *Inter Partes* Review; filed Jun. 4, 2018; 18 pages (paper 21).
*Nautilus, Inc.* v. *ICON Health & Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *ICON Health & Fitness, Inc.*, Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).
*Nautilus, Inc.* v. *ICON Health & Fitness, Inc.*, Civil Case No. IPR2017-01363, Order granting Motion for Pro Hac Vice Admission—37 C.F.R. 42.10(c), filed Jun. 14, 2018; 4 pages (paper 23).
*Nautilus, Inc.* v. *ICON Health & Fitness, Inc.*, Civil Case No. IPR2017-01363, Petitioner's Updated Mandatory Notices, filed Jun. 20, 2018; 4 pages (paper 24).
*Nautilus, Inc.* v. *ICON Health & Fitness, Inc.*, Civil Case No. IPR2017-01363, Petitioner's Updated Power of Attorney, filed Jun. 20, 2018; 3 pages (paper 25).
*Nautilus, Inc.* v. *ICON Health & Fitness, Inc.*, Civil Case No. IPR2017-01363, Petitioner's Request for Oral Argument, filed Jul. 25, 2018; 4 pages; (paper 26).
*Nautilus, Inc.* v. *ICON Health & Fitness, Inc.*, Civil Case No. IPR2017-01363, Patent Owner's Request for Oral Argument, filed Jul. 25, 2018; 4 pages (paper 27).
*Nautilus, Inc.* v. *ICON Health & Fitness, Inc.*, Civil Case No. IPR2017-01363, Order 37 C.F.R. 42.70, filed Aug. 14, 2018, 5 pages (paper 28).
*Nautilus, Inc.* v. *ICON Health & Fitness, Inc.*, Civil Case No. IPR2017-01363, Current Exhibit List of Patent Owner, filed Aug. 24, 2018, 3 pages (paper 29).
*Nautilus, Inc.* v. *ICON Health & Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *ICON Health & Fitness, Inc.*, Civil Case No. IPR2017-01363, Petitioner's Updated Exhibit List, filed Aug. 24, 2018, 4 pages (paper 31).
*Nautilus, Inc.* v. *ICON Health & Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *ICON Health & Fitness, Inc.*, Civil Case No. IPR2017-01363; Patent Owner Demonstrative Exhibits; filed Aug. 24, 2018, 10 pages (exhibit 2003).
*Nautilus, Inc.* v. *ICON Health & Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *ICON Health & Fitness, Inc.*, Civil Case No. IPR2017-01407, Patent Owner's Objections to Evidence, filed Jun. 7, 2018, 5 pages (paper 22).

(56) References Cited

OTHER PUBLICATIONS

*Nautilus, Inc.* v. *ICON Health & Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *ICON Health & Fitness, Inc.*, Civil Case No. IPR2017-01407, Order—Granting Motion for Pro Hac Vice Admission, filed Jun. 14, 2018, 4 pages (paper 24).
*Nautilus, Inc.* v. *ICON Health & Fitness, Inc.*, Civil Case No. IPR2017-01407, Petitioner's Updated Mandatory Notices, filed Jun. 20, 2018, 4 pages, (paper 25).
*Nautilus, Inc.* v. *ICON Health & Fitness, Inc.*, Civil Case No. IPR2017-01407, Petitioner's Updated Power of Attorney, filed Jun. 20, 2018, 3 pages, (paper 26).
*Nautilus, Inc.* v. *ICON Health & Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *ICON Health & Fitness, Inc.*, Civil Case No. IPR2017-01407, Current Exhibit List for Patent Owner, filed Jul. 5, 2018, 4 pages, (paper 28).
*Nautilus, Inc.* v. *ICON Health & Fitness, Inc.*, Civil Case No. IPR2017-01407, Patent Owners Updated Mandatory Notices, filed Jul. 5, 2018, 4 pages, (paper 29).
*Nautilus, Inc.* v. *ICON Health & Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *ICON Health & Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *ICON Health & Fitness, Inc.*, Civil Case No. IPR2017-01407, Petitioner's Objections to Evidence, filed Jul. 12, 2018, 4 pages (paper 32).
*Nautilus, Inc.* v. *ICON Health & Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *ICON Health & Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *ICON Health & Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *ICON Health & Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *ICON Health & Fitness, Inc.*, Civil Case No. IPR2017-01407, Order Conduct of the Proceeding, filed Aug. 7, 2018, 4 pages (paper 37).
*Nautilus, Inc.* v. *ICON Health & Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *ICON Health & Fitness, Inc.*, Civil Case No. IPR2017-01407, Patent Owner's Request for Oral Argument, filed Aug. 10, 2018, 4 pages , (paper 39).
*Nautilus, Inc.* v. *ICON Health & Fitness, Inc.*, Civil Case No. IPR2017-01407, Petitioner's Request for Oral Argument, filed Aug. 10, 2018, 4 pages, (paper 40).
*Nautilus, Inc.* v. *ICON Health & Fitness, Inc.*, Civil Case No. IPR2017-01407, Patent Owner's Motion to Exclude Evidence, filed Aug. 10, 2018, 11 pages (paper 41).
*Nautilus, Inc.* v. *ICON Health & Fitness, Inc.*, Civil Case No. IPR2017-01407, Order 37 C.F.R. 42.70, filed Aug. 14, 2018, 5 pages (paper 42).
*Nautilus, Inc.* v. *ICON Health & Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *ICON Health & Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *ICON Health & Fitness, Inc.*, Civil Case No. IPR2017-01407, Current Exhibit List of Patent Owner, filed Aug. 24, 2018, 4 pages (paper 46).
*Nautilus, Inc.* v. *ICON Health & Fitness, Inc.*, Civil Case No. IPR2017-01407, Order re PO Sur-Rebuttal at Hearing, filed Aug. 24, 2018, 4 pages (paper 47).
*Nautilus, Inc.* v. *ICON Health & Fitness, Inc.*, Civil Case No. IPR2017-01407, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01407, Exhibit 1013—U.S. Pat. No. 9,044,635 (Lull), filed Jun. 4, 2018, 21 pages.
*Nautilus, Inc.* v. *ICON Health & Fitness, Inc.*, Civil Case No. IPR2017-01407, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01407, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01407, Exhibit 1016—US20120258433A1 (Hope), filed Jun. 4, 2018, 51 pages.
*Nautilus, Inc.* v. *ICON Health & Fitness, Inc.*, Civil Case No. IPR2017-01407, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01407, Exhibit 1020—S. Ganaja Depo Transcript, filed Aug. 1, 2018, 58 pages.
*Nautilus, Inc.* v. *ICON Health & Fitness, Inc.*, Civil Case No. IPR2017-01407, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *ICON Health & Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *ICON Health & Fitness, Inc.*, Civil Case No. IPR2017-01407, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01407, Exhibit 2014—Patent Owner Demonstrative Exhibits, filed Aug. 24, 2018, 21 pages.
*Nautilus, Inc.* v. *ICON Health & Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *ICON Health & Fitness, Inc.*, Civil Case No. IPR2017-01408, Petitioners Motion for Pro Hac Vice Admission, filed Jun. 6, 2018, 5 pages (paper 22).
*Nautilus, Inc.* v. *ICON Health & Fitness, Inc.*, Civil Case No. IPR2017-01408, Patent Owner's Objections to Evidence, filed Jun. 7, 2018, 5 pages (paper 23).
*Nautilus, Inc.* v. *ICON Health & Fitness, Inc.*, Civil Case No. IPR2017-01408, Declaration R. Lee Rawls, Part 1, dated May 12, 2017, 447 pages, (paper 24).
*Nautilus, Inc.* v. *ICON Health & Fitness, Inc.*, Civil Case No. IPR2017-01408, Declaration R. Lee Rawls, Part 2, dated May 12, 2017, 216 pages, (paper 24).
*Nautilus, Inc.* v. *ICON Health & Fitness, Inc.*, Civil Case No. IPR2017-01408, Order granting Motion for Pro Hac Vice Admission, filed Jun. 14, 2018, 4 pages (paper 25).
*Nautilus, Inc.* v. *ICON Health & Fitness, Inc.*, Civil Case No. IPR2017-01408, Petitioner's Updated Mandatory Notices, filed Jun. 20, 2018, 4 pages, (paper 26).
*Nautilus, Inc.* v. *ICON Health & Fitness, Inc.*, Civil Case No. IPR2017-01408, Petitioner's Updated Power of Attorney, filed Jun. 20, 2018, 3 pages, (paper 27).

(56) References Cited

OTHER PUBLICATIONS

*Nautilus, Inc.* v. *ICON Health & Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *ICON Health & Fitness, Inc.*, Civil Case No. IPR2017-01408, Current Exhibit List of Patent Owner, filed Jul. 5, 2018, 4 pages, (paper 29).
*Nautilus, Inc.* v. *ICON Health & Fitness, Inc.*, Civil Case No. IPR2017-01408, Patent Owner's Updated Mandatory Notices, filed Jul. 5, 2018, 4 pages, (paper 30).
*Nautilus, Inc.* v. *ICON Health & Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *ICON Health & Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *ICON Health & Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *ICON Health & Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *ICON Health & Fitness, Inc.*, Civil Case No. IPR2017-01408, Order—Conduct of the Proceeding, 37 C.F.R. 42.5, filed Jul. 20, 2018, 5 pages (paper 35).
*Nautilus, Inc.* v. *ICON Health & Fitness, Inc.*, Civil Case No. IPR2017-01408, Petitioner's Sur-Reply in Support of Opposition to Patent Owners Motions to Amend, filed Aug. 1, 2018, 19 pages, (paper 36).
*Nautilus, Inc.* v. *ICON Health & Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *ICON Health & Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *ICON Health & Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *ICON Health & Fitness, Inc.*, Civil Case No. IPR2017-01408, Patent Owner's Request for Oral Argument, filed Aug. 10, 2018, 4 pages, (paper 40).
*Nautilus, Inc.* v. *ICON Health & Fitness, Inc.*, Civil Case No. IPR2017-01408, Petitioner's Request for Oral Argument, filed Aug. 10, 2018, 4 pages, (paper 41).
*Nautilus, Inc.* v. *ICON Health & Fitness, Inc.*, Civil Case No. IPR2017-01408, Patent Owner's Motion to Exclude Evidence, filed Aug. 10, 2018, 11 pages (paper 42).
*Nautilus, Inc.* v. *ICON Health & Fitness, Inc.*, Civil Case No. IPR2017-01408, Order—Oral Hearing 37 C.F.R. 42.70, filed Aug. 14, 2018, 5 pages (paper 43).
*Nautilus, Inc.* v. *ICON Health & Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *ICON Health & Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *ICON Health & Fitness, Inc.*, Civil Case No. IPR2017-01408, Current Exhibit List of Patent Owner, filed Aug. 24, 2018, 4 pages (paper 47).
*Nautilus, Inc.* v. *ICON Health & Fitness, Inc.*, Civil Case No. IPR2017-01408, Order Conduct of the Proceedings—37 C.F.R. 42.5, filed Aug. 24, 2018, 4 pages, (paper 48).
*Nautilus, Inc.* v. *ICON Health & Fitness, Inc.*, Civil Case No. IPR2017-01408, Petitioner's Updated Exhibit List, filed Aug. 24, 2018, 5 pages, (paper 49).
*Nautilus, Inc.* v. *ICON Health & Fitness, Inc.*, Civil Case No. IPR2017-01408, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01408, Exhibit 1013—U.S. Pat. No. 9,044,635 (Lull), filed Jun. 4, 2018, 21 pages.
*Nautilus, Inc.* v. *ICON Health & Fitness, Inc.*, Civil Case No. IPR2017-01408, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01408, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01408, Exhibit 1016—US20120258433A1 (Hope), filed Jun. 4, 2018, 51 pages.
*Nautilus, Inc.* v. *ICON Health & Fitness, Inc.*, Civil Case No. IPR2017-01408, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01408, Exhibit 1020—Scott Ganaja Depo Transcript, filed Aug. 1, 2018, 58 pages.
*Nautilus, Inc.* v. *ICON Health & Fitness, Inc.*, Civil Case No. IPR2017-01408, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
*Nautilus, Inc.* v. *ICON Health & Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
*Nautilus, Inc.* v. *ICON Health & Fitness, Inc.*, Civil Case No. IPR2017-01408, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01408, Exhibit 2014—Patent Owner's Demonstrative Exhibits, filed Aug. 24, 2018, 21 pages.
European Patent Office, Article 94(3) EPC Communication dated Jul. 10, 2018, issued in European Patent Application No. 14768130.8-1126, 3 pages.
United States Patent and Trademark Office; International Search Report and Written Opinion issued in application No. PCT/US2015/034665; dated Oct. 8, 2015 (14 pages).
*Nautilus, Inc.* v. *ICON Health & Fitness, Inc.*, Civil Case Nos. IPR2017-01363, IPR2017-01407, and IPR2017-01408 Record of Oral Hearing held Aug. 29, 2018; (paper 32) 104 pages.
*Nautilus, Inc.* v. *ICON Health & Fitness, Inc.*, Civil Case No. IPR2017-01407—Petitioner's Updated Exhibit List, filed Aug. 24, 2018, (paper 48) 5 pages.
*Nautilus, Inc.* v. *ICON Health & Fitness, Inc.*, Civil Case No. IPR2017-01363, Final Written Decision dated Nov. 28, 2018; (paper 33) 29 pages.
*Nautilus, Inc.* v. *ICON Health & Fitness, Inc.*, Civil Case Nos. IPR2017-01407, Final Written Decision dated Dec. 3, 2018; (paper 50) 81 pages.
*Nautilus, Inc.* v. *ICON Health & Fitness, Inc.*, Civil Case Nos. IPR2017-01408, Final Written Decision dated Dec. 3, 2018; (paper 51) 82 pages.
U.S. Appl. No. 16/572,272, filed Sep. 16, 2019, titled "Cable Exercise Machine", (35 pages).
U.S. Appl. No. 62/310,467, filed Mar. 18, 2016, titled "Collapsible Strength Exercise Machine", 31 pages.
U.S. Appl. No. 62/429,977, filed Dec. 5, 2016, titled "Pull Cable Resistance Mechanism in a Treadmill", 37 pages.
U.S. Appl. No. 62/429,970, filed Dec. 5, 2016, titled "Tread Belt Locking Mechanism", 37 pages.

(56) References Cited

OTHER PUBLICATIONS

International Bureau of WIPO; International Preliminary Report on Patentability; Int'l App No. PCT/US2017/064523 dated Jun. 11, 2019; 7 pages.
International Bureau of WIPO; International Preliminary Report on Patentability; Int'l App No. PCT/US2017/064536 dated Jun. 11, 2019; 8 pages.
Chinese Second Office Action for Chinese Patent Application No. 201480003701.9 dated Nov. 21, 2016.
Chinese Third Office Action for Chinese Patent Application No. 201480003701.9 dated Nov. 24, 2017.
Chinese Office Action for Chinese Patent Application No. 201580033332 dated Feb. 28, 2018.
Chinese Second Office Action for Chinese Patent Application No. 201580033332 dated Nov. 15, 2018.
Nordic Track Fusion CST Series; website; located at: http://www/nordictrack.com/fusion-cst-series; accessed on Jan. 24, 2018; 11 pages.
U.S. Appl. No. 15/460,984, dated Jun. 24, 2019, Notice of Allowance.

* cited by examiner

PULL CABLE RESISTANCE MECHANISM IN A TREADMILL

RELATED APPLICATIONS

This application claims priority to U.S. Patent Application Ser. No. 62/429,977 titled "Pull Cable Resistance Mechanism in a Treadmill" and filed on 5 Dec. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes, to name a few.

One type of treadmill is disclosed in U.S. Pat. No. 7,575,537, issued to Joseph K. Ellis, et al. In this reference, an exercise treadmill is described as having an endless moveable surface looped around rollers or pulleys to form an upper run and a lower run, the movable surface being rotated when one of the rollers or pulleys is rotated, and an exercise surface for walking or running while exercising, a weight resistance mechanism for providing a weight resistance for simulating the dragging or pulling of a load, wherein the weight resistance can be adjusted and set to a specific weight resistance setting; a movable hand controller operatively attached to the weight resistance mechanism for operating and controlling the exercise treadmill and the weight resistance mechanism, wherein the endless movable surface moves in a direction simulating walking or running backwards, and wherein the weight resistance mechanism applies a constant and static force to the hand controller generally only in the same as the direction the endless movable surface moves and opposite a pulling direction, whereby operation of the treadmill simulates the dragging or pulling of a load by a combination of the actuation of the weight resistance mechanism to simulate the load and the walking or running backwards to provide the dragging or pulling action. Other treadmills are described in U.S. Patent Publication Nos. 2007/0232463 issued to Yu Feng Wu and 2015/0352396 issued to William T. Dalebout, which references are incorporated herein by reference, in their entireties.

SUMMARY

In one embodiment, a treadmill includes a deck, a first pulley disposed in a first portion of the deck, a second pulley disposed in a second portion of the deck, a tread belt surrounding the first pulley and the second pulley, an upright structure connected to the deck, and a pull cable incorporated into the upright structure.

The treadmill may also include a handle connected to a first end of the pull cable and a resistance mechanism connected to a second end of the pull cable.

The treadmill may include a flywheel of the resistance mechanism, where the flywheel is incorporated into the upright structure, and a magnetic unit that applies a resistance to a rotation of the flywheel.

The treadmill may include a sensor that detects movement of the flywheel.

The treadmill may include a console incorporated into the upright structure and a display incorporated into the console.

The treadmill may include a processor and memory having programmed instructions that, when executed, cause the processor to display exercise information about a workout performed on the treadmill, including exercises using the pull cable.

The treadmill may include an aerobic data set derived from a rotation of the flywheel and an anaerobic data set derived from movement of the tread belt.

The flywheel may be in selective mechanical communication with the pull cable and the tread belt.

The treadmill may include a first pivot connection between the deck and the upright structure, where the first pivot connection allows the deck to rotate upwards towards the upright structure into a storage orientation.

The treadmill may include a support rail and a second pivot connection attaching the support rail to the upright structure.

The deck may push the support rail up into an upright orientation about the second pivot connection when the deck is in the storage orientation.

The treadmill may include a latch that holds the deck in the storage orientation and the support rail in the upright orientation simultaneously.

The support rail may be transversely oriented with respect to a length of the deck.

In one embodiment, a method includes displaying a first data set relating to an aerobic segment of a workout on the treadmill and displaying a second data set relating to an anaerobic segment of the workout on the treadmill.

In one embodiment, a treadmill includes a deck, a first pulley disposed in a first portion of the deck, a second pulley disposed in a second portion of the deck, a tread belt surrounding the first pulley and the second pulley, an upright structure connected to the deck, and a pull cable incorporated into the upright structure. The treadmill may further include a processor, memory in electronic communication with the processor, and instructions stored in the memory. The instructions cause the processor to display a first data set relating to an aerobic segment of a workout on the treadmill and display a second data set relating to an anaerobic segment of the workout on the treadmill.

The treadmill may include processes, features, means, or instructions for displaying a first set of data may be derived from movement of a tread belt and displaying a second set of data may be derived from rotation of a flywheel incorporated into the treadmill.

The treadmill may include processes, features, means, or instructions for displaying a third data set derived from a combination of the aerobic segment and the anaerobic segment.

The third data set may relate to a physiological condition of the user during the workout.

Displaying the third data set may include displaying a heart rate.

Displaying the third data set may include displaying a calorie burn.

Displaying a third set of data may include displaying a workout duration.

Displaying a second data set may include displaying a pull force.

Displaying a second data set may include displaying a repetition count.

Displaying a second data set may include displaying a resistance level.

Displaying a first set of data may include displaying a tread belt speed.

In one embodiment, a treadmill includes a deck, a first pulley disposed in a first portion of the deck, a second pulley disposed in a second portion of the deck, a tread belt surrounding the first pulley and the second pulley, an upright structure connected to the deck, a pull cable incorporated into the upright structure, a handle connected to a first end of the pull cable, a resistance mechanism connected to a second end of the pull cable, a flywheel of the resistance mechanism, the flywheel being incorporated into the upright structure, a magnetic unit that applies a resistance to a rotation of the flywheel, a support rail, a second pivot connection attaching the support rail to the upright structure where the deck pushes the support rail up into an upright orientation about the second pivot connection when the deck is the storage orientation, a processor, memory having programmed instructions that, when executed, cause the processor to display a first data set relating to an aerobic segment of a workout on the treadmill and display a second data set relating to an anaerobic segment of the workout on the treadmill.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length.

Figure 1:
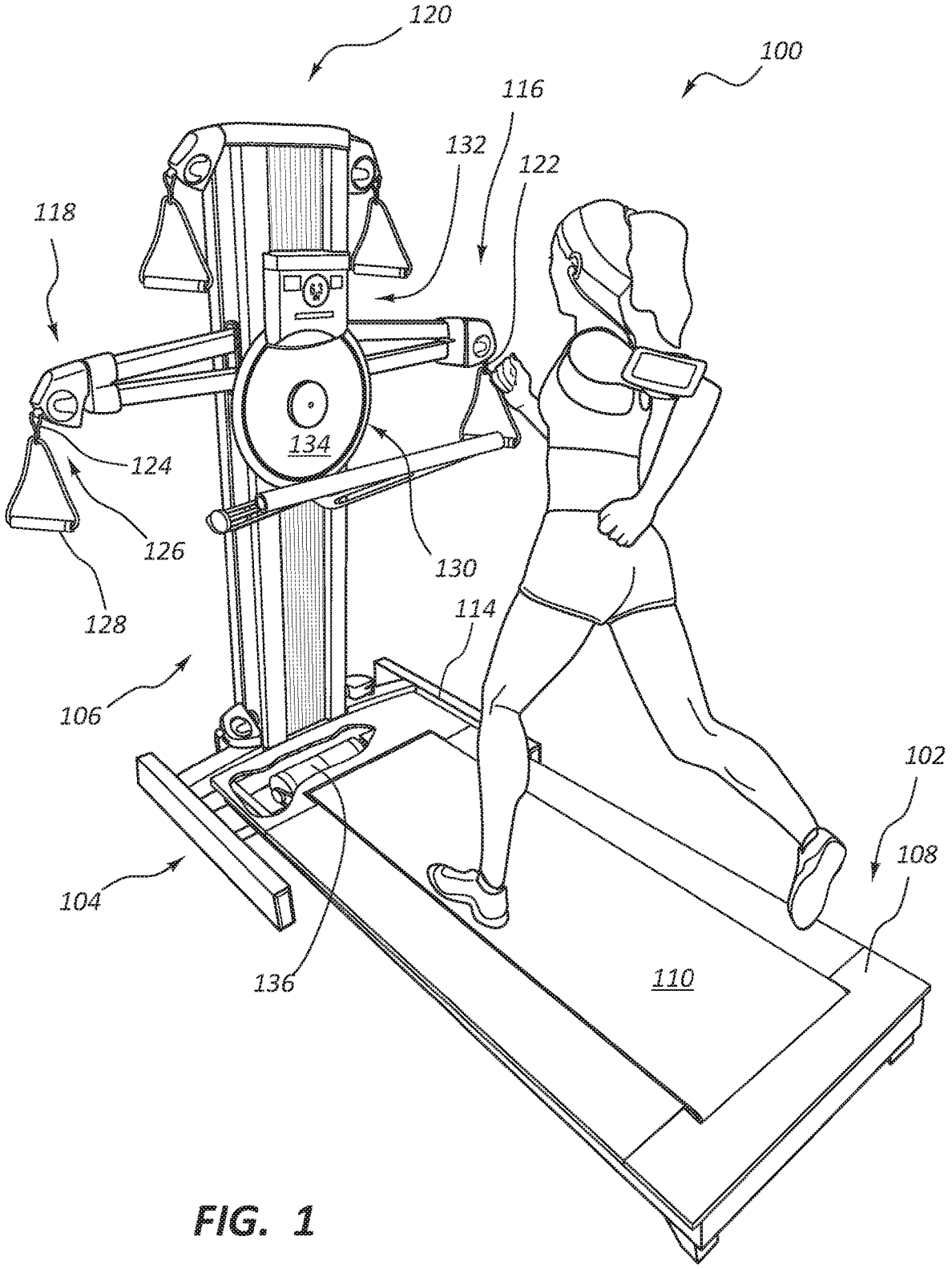
FIG. 1 depicts a perspective view of an example of a treadmill in accordance with aspects of the present disclosure.

FIG. 1 depicts an example of a treadmill 100 that includes a deck 102, a base 104, and an upright structure 106. The deck 102 includes a platform 108 with a front pulley connected to a front portion of the platform 108, and a rear pulley connected to a rear portion of the platform 108. A tread belt 110 surrounds a portion of the platform, the front pulley, and the second pulley. A motor (not shown) can drive either the front pulley or the rear pulley and cause the tread belt 110 to move along a surface of the platform 108.

An incline mechanism (not shown) is integrated into the base 104 and controls an elevation of the front portion of the deck 102. The front portion of the deck is also connected to the base 104 at a pivot connection 114. As the incline mechanism raises the front portion of the deck, the rear portion of the deck 102 remains in contact with the floor, thus, the front portion of the deck 102 inclines with respect to the base 104.

An upright structure 106 is connected to the base 104. In this example, the upright structure includes a first arm 116 and a second arm 118 extending away from a central portion 120 of the upright structure 106. The first arm 116 supports a first cable 122, and the second arm 118 supports a second cable 124. The first and second cables each have an end 126 that is attached to a handle 128. The other end of the first and second cables are attached to a resistance mechanism 130 that is connected to the upright structure 106. A display 132 is also attached to the upright structure 106 which displays information about the user's workout involving the movement of the tread belt. In this example, the resistance mechanism includes a flywheel 134, and the rotation of the flywheel is resisted with a magnetic unit.

In this example, a user is exercising on the deck 102 with the tread belt 110 moving. The movement of the tread belt may be driven by a motor 136. In other examples, the movement of the tread belt 110 may be driven by the user's feet and resisted by the interaction between the flywheel 134 and the magnetic unit.

Figure 2:
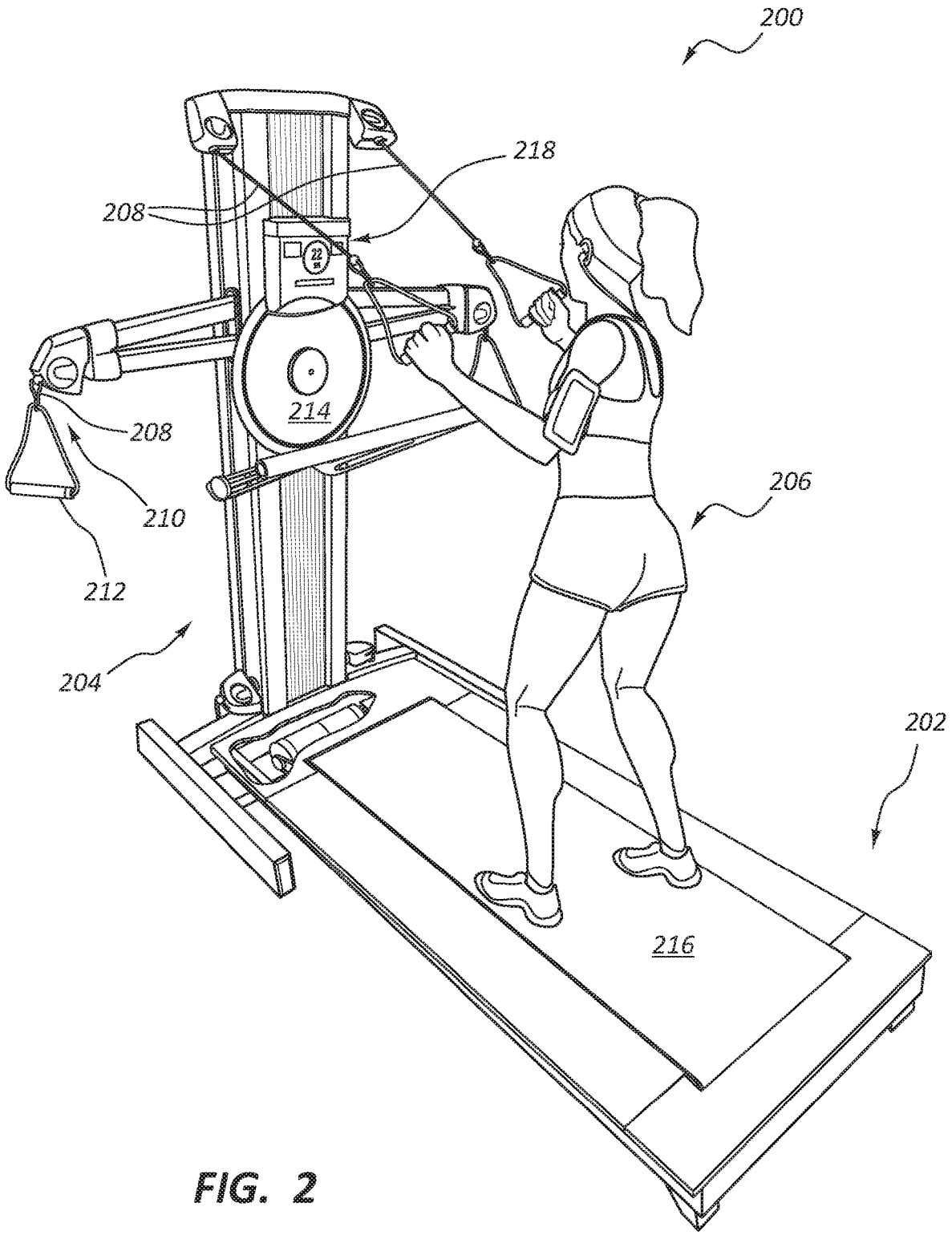
FIG. 2 depicts a perspective view of an example of a treadmill in accordance with aspects of the present disclosure.

FIG. 2 illustrates an example of a treadmill 200 with the deck 202 and the upright structure 204. In this example, the user 206 is exercising with the pull cables 208 incorporated into the upright structure 204. As the user pulls the end 210 of the pull cable 208 with the handle 212, the pull cable 208 moves along its length. The end of the pull cable 208 is connected to the resistance mechanism and causes the flywheel 214 to rotate against resistance.

Further, in the illustrated example, the user 206 stands on the tread belt 216 while performing an exercise with the pull cables 208. While the user 206 is executing the pull cable exercises, the tread belt 216 is locked in place so that the tread belt 216 cannot move. As a result, the user 206 can stand on the tread belt and pull against resistance without having the tread belt 216 move from the pull cable exercises. In this example, the display 218 presents information about the user's workout involving the movement of the pull cables 208.

Figure 3:
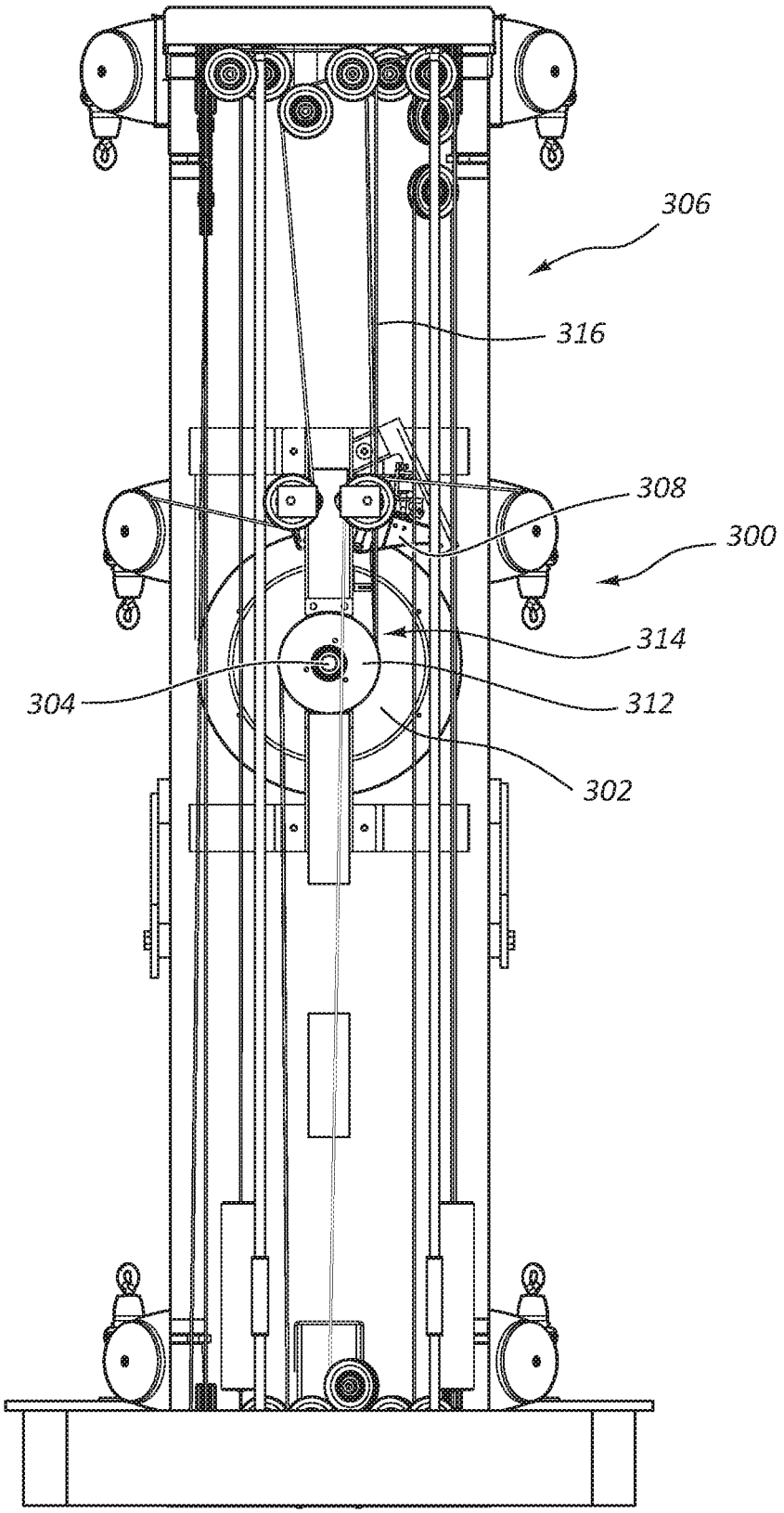
FIG. 3 depicts a rear view of an example of a resistance mechanism in accordance with aspects of the present disclosure.

FIG. 3 illustrates an example of a resistance mechanism 300. In this example, the resistance mechanism 300 includes a flywheel 302 that is supported by an axle 304 connected to the upright structure 306. A magnetic unit 308 is positioned adjacent to the flywheel 302. In some examples, the magnetic unit 308 is positioned adjacent to a periphery of the flywheel 302. The magnetic unit 308 may impose a magnetic force on the flywheel 302 that resists the flywheel's rotation. In some cases, the strength of the magnetic unit's resistance may be increased by moving the magnetic unit 308 closer to the flywheel 302. Conversely, in the same example, the strength of the resistance may be lowered by moving the magnetic unit farther away from the flywheel 302. In an alternative example, the strength of the magnetic unit 308 may be altered by changing an electrical power level to the magnetic unit 308. Also disposed on the axle 304 is a spool 312 where the second end 314 of the pull cable 316 connects to the resistance mechanism 300. As the pull cable 316 is pulled from the first end, the second end 318 of the cable moves causing the spool 312 to rotate.

Figure 4:
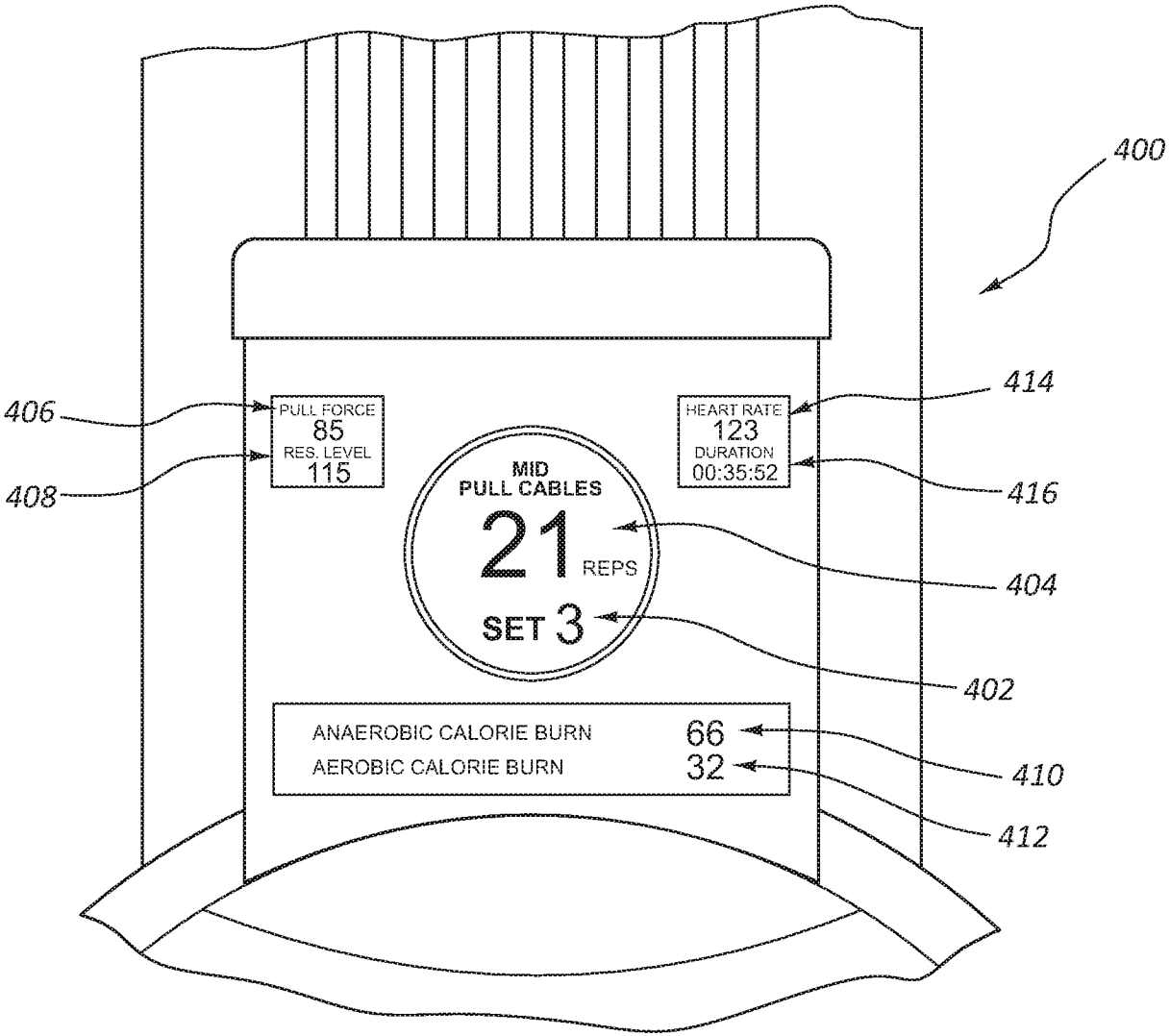
FIG. 4 depicts an example of a display in accordance with aspects of the present disclosure.

FIG. 4 illustrates an example of a display 400. In this example, the display 400 may have fields for presenting a number of pull cable sets 402, a number of pull cable repetitions 404, an average pull force 406 on the cable, a resistance level 408, an anaerobic calorie burn 410, an aerobic calorie burn 412, a heart current rate 414, and a running time duration 416.

Figure 5:
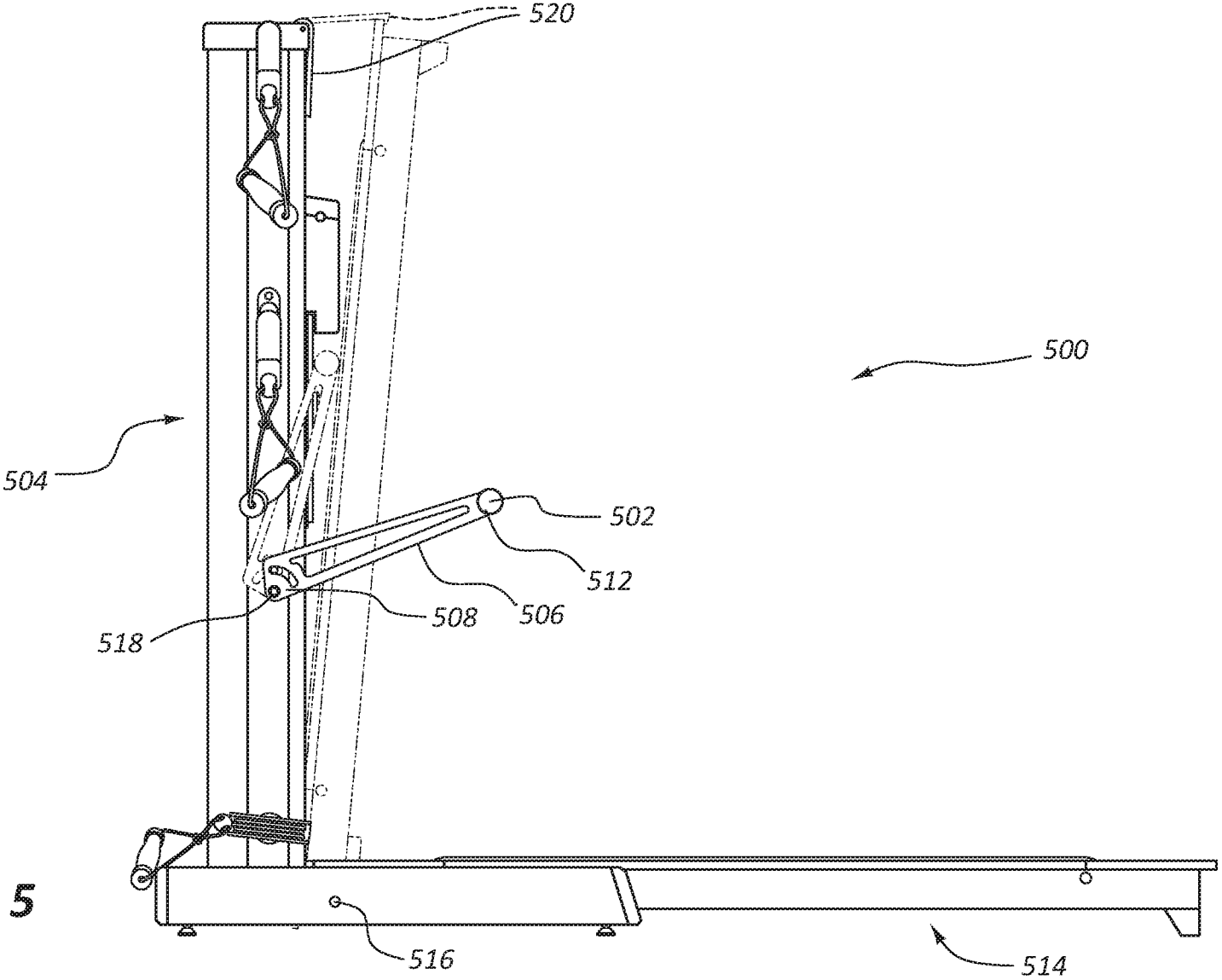
FIG. 5 depicts a side view of an example of a treadmill in accordance with aspects of the present disclosure.

FIG. 5 illustrates an example of a treadmill 500. In this example, a handrail 502 is connected to the upright structure 504. The handrail 502 includes a first post 506 connected to a first side 508, and a second post (not shown) connected to a second side 512. Each of the first and second posts 506, 510 are pivotally connected to the upright structure.

The deck 514 may be connected to the upright structure 504 at a base pivot connection 516. As the deck 514 is rotated upwards, the deck 514 engages the handrail 502 before arriving at the deck's storage position. As the deck 514 continues to move upward after engaging the handrail 502, the posts 506 of the handrail 502 rotate about the post pivot connections 518. Thus, as the deck 514 continues to move upward, the deck 514 and the handrail 502 move upward together. When the deck 514 arrives at the storage position, a latch 520 may be used to hold the deck 514 in the storage position. Thus, the deck 514 and the handrail 502 are held in an upward, storage position with a single latch 520.

Figure 6:
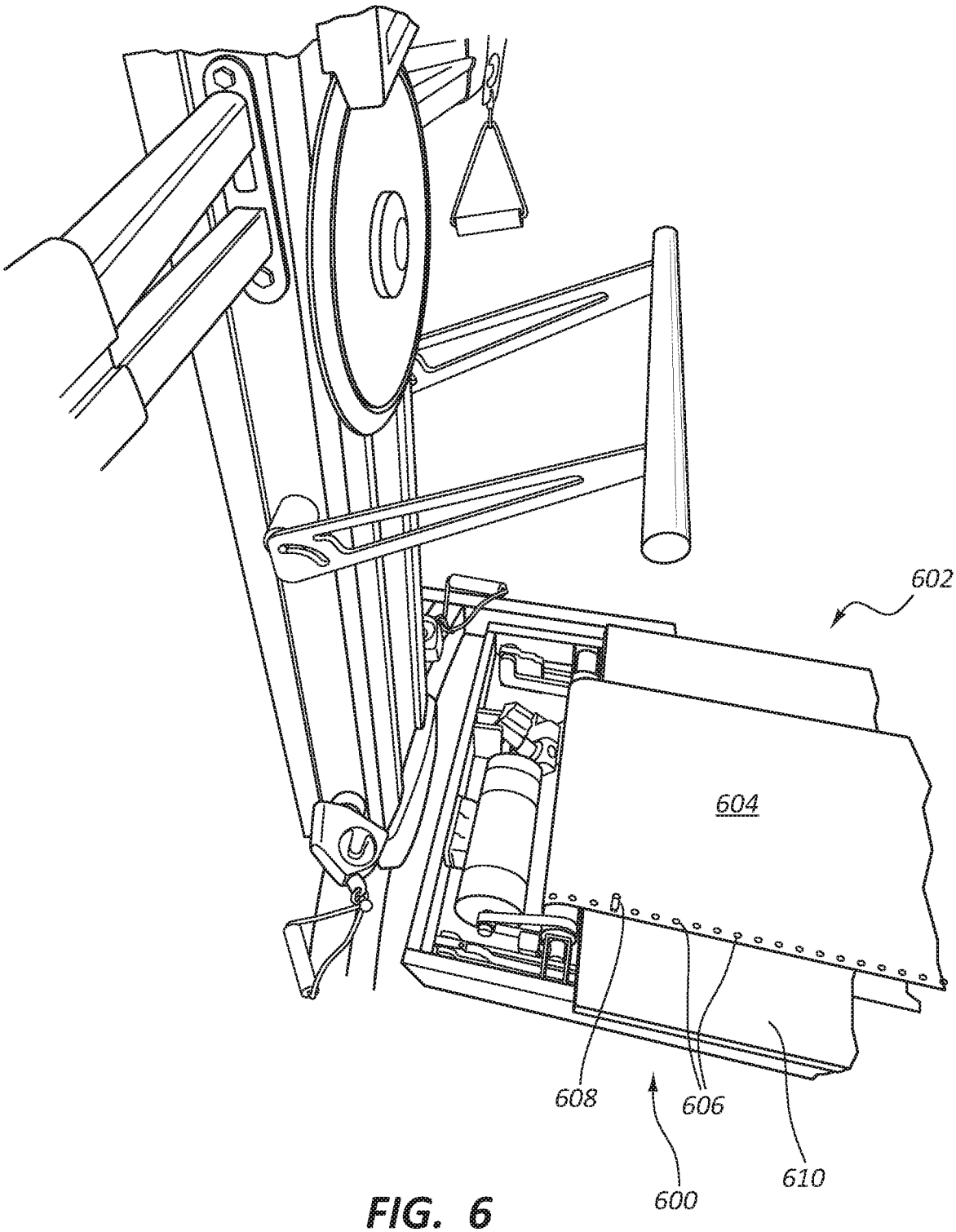
FIG. 6 depicts a partially deconstructed top perspective view of an example of a locking mechanism in accordance with aspects of the present disclosure.

FIG. 6 illustrates an example of a locking mechanism 600. In this example, a tread belt 602 includes a surface 604 with an opening 606 defined in the surface 604. A retractable pin 608 connected to the deck 610 can be positioned adjacent to the opening 606 and be insertable into the opening 606. With the pin 608 inserted into the opening 606, the tread belt 602 is locked in place so that the tread belt 602 does not move.

Figure 7:
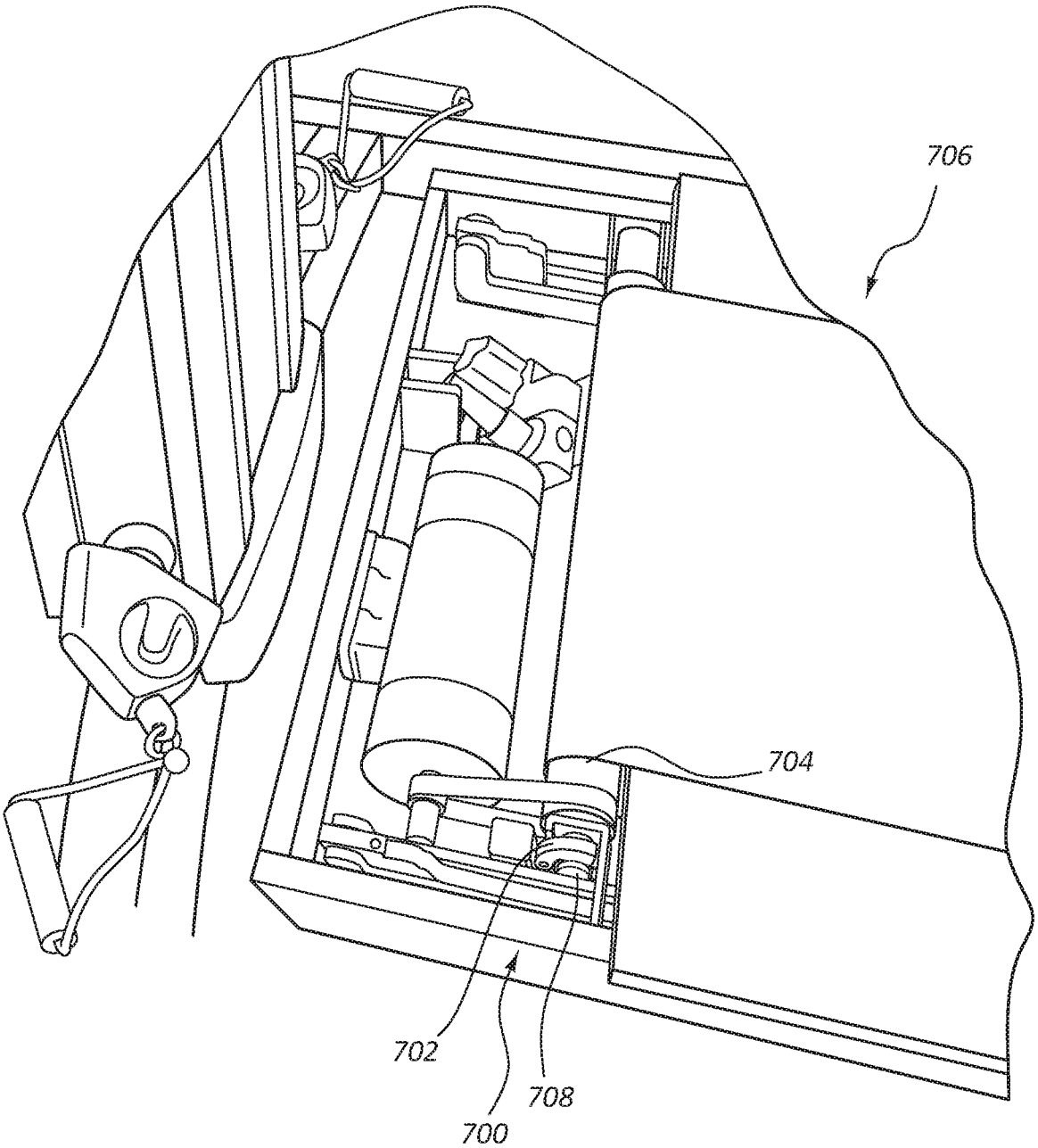
FIG. 7 depicts a cutaway view of an example of a locking mechanism in accordance with aspects of the present disclosure.

FIG. 7 illustrates an example of an alternative locking mechanism 700. In this example, the locking mechanism includes a clamp 702 that is positioned adjacent to a pulley 704 that drives the tread belt 706. The clamp 702 can apply a force on the pulley 704 or on an axle 708 supporting the pulley 704 so that the pulley 704 and/or the axle 708 cannot rotate. This can lock the tread belt 706 in place. Alternatively, the clamp 702 may be positioned adjacent to the tread belt 602 and may impart a stopping force directly to the treadbelt, pinning it between the clamp 702 and the pulley 704 to lock it in place. the clamp may be actuated in any number of ways including, but not limited to, mechanically, hydraulically, electrically with a solenoid, and the like.

Figure 8:
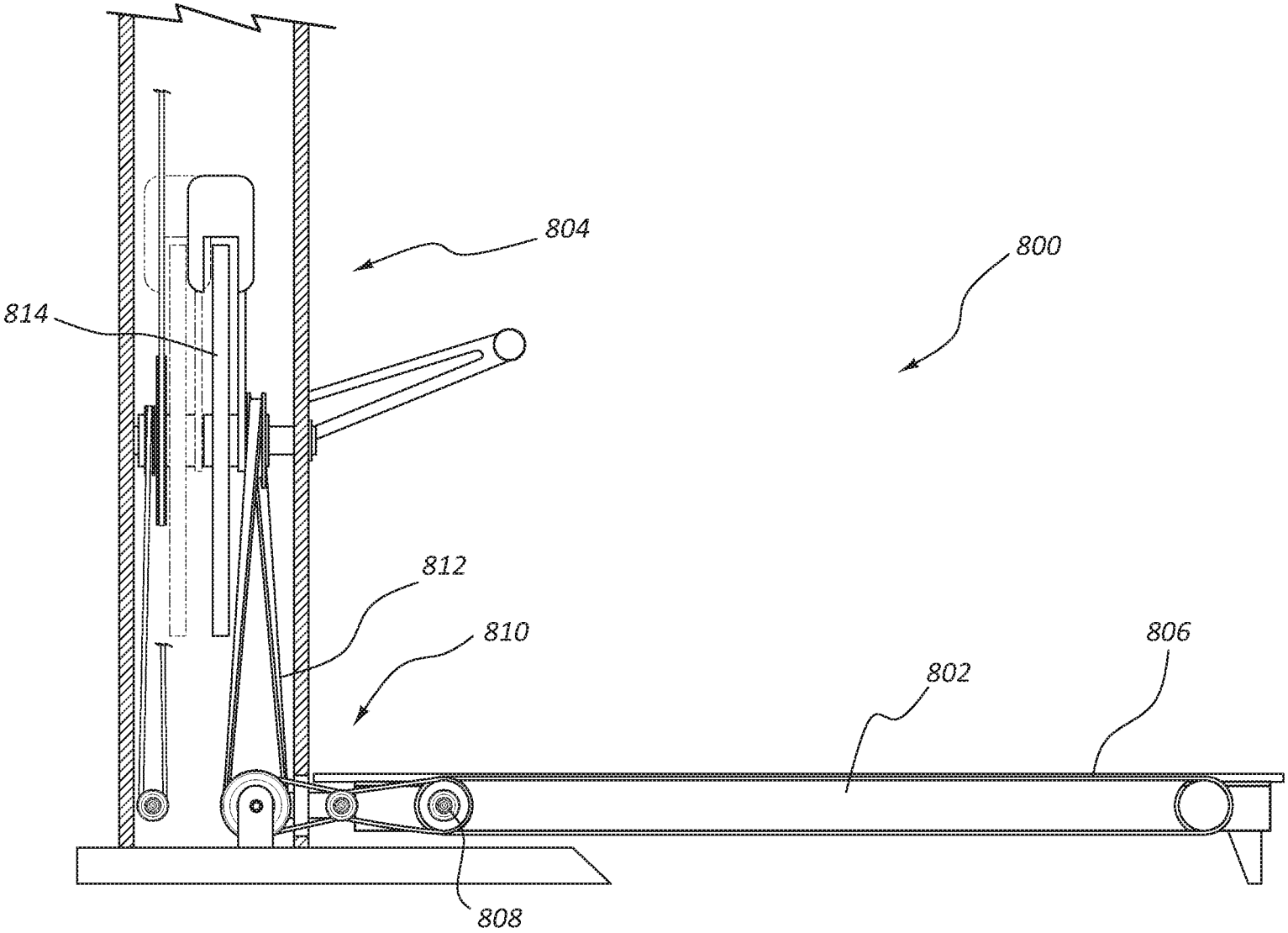
FIG. 8 depicts a cutaway side view of an example of a treadmill in accordance with aspects of the present disclosure.

FIG. 8 illustrates an example of a treadmill 800. In this example, the treadmill 800 includes a deck 802 and an upright structure 804. The deck 802 includes a tread belt 806 that is driven by the user's power. In this example, as the user causes the tread belt 806 to move with his or her legs, the front pulley 808 rotates. A transmission system 810 includes a transmission linkage 812 that connects the front pulley 808 to the flywheel 814 in the upright structure 804. As the tread belt 806 continues to move, the inertia of the tread belt's movement is stored in the flywheel 814. When the tread belt 806 is locked in place with the locking mechanism 816, the flywheel can be used to provide resistance to the user's pull cable exercises. Thus, a single flywheel 814 may be used for the aerobic exercises and the pull cable exercises.

Figure 9:
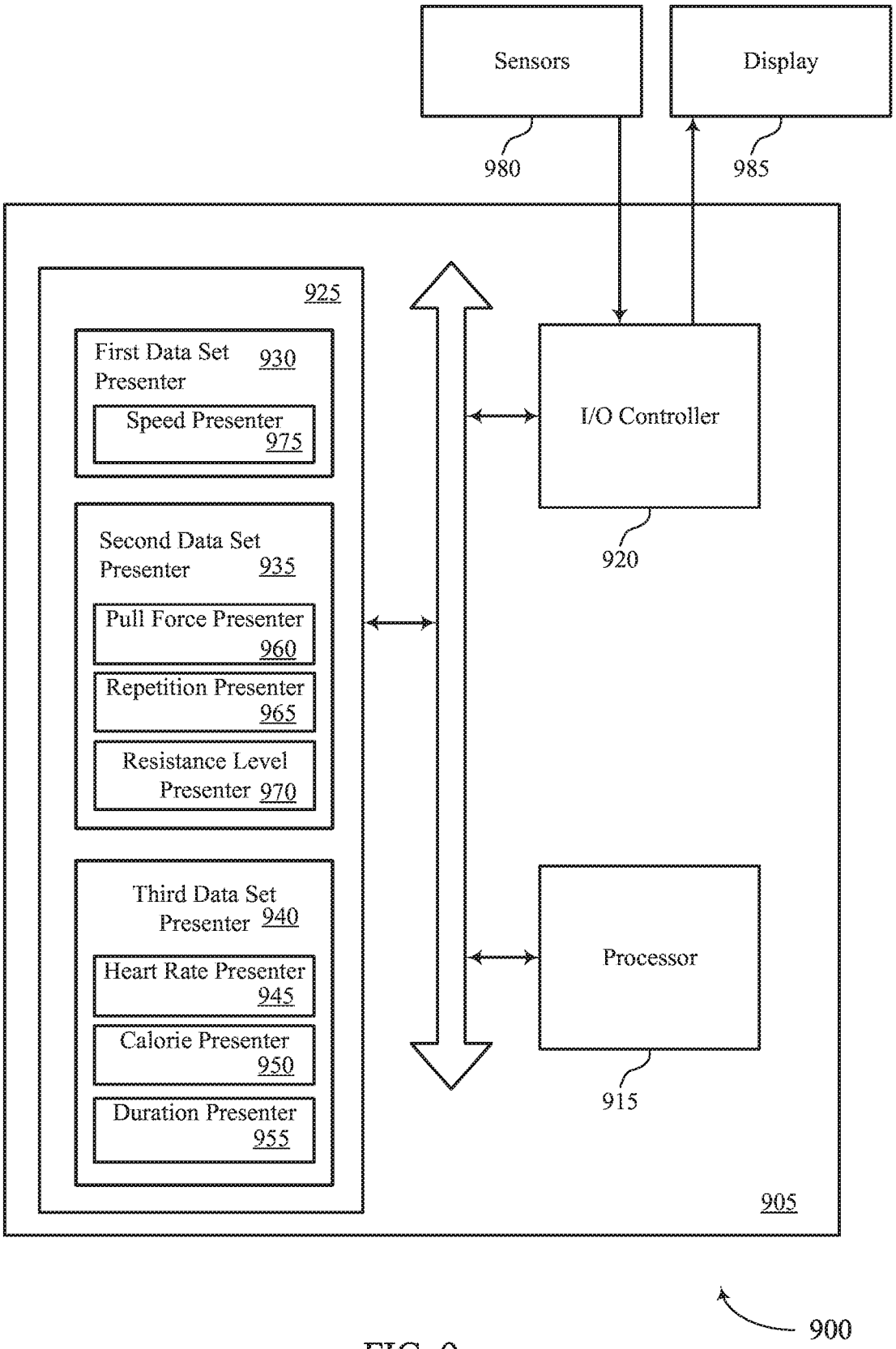
FIG. 9 depicts an example of a block diagram of a system including a treadmill in accordance with aspects of the present disclosure.

FIG. 9 shows a diagram of a device 900 incorporated into a treadmill 905. The treadmill 905 may include components for bi-directional voice and data communications including components for transmitting and receiving communications, including processor 915, I/O controller 920, and memory 925. Memory 925 may also include a first data set presenter 930, a second data set presenter 935, and a third data set presenter 940.

The first data set presenter 930 may include a speed presenter 975. While the illustrated example depicts the first data set presenter 930 including just a speed presenter, other types of presenters may be included, such as a time duration presenter, a calorie presenter, an incline presenter, a tilt presenter, another type of presenter, or combinations thereof.

The second data set presenter 935 may include a pull force presenter 960, a repetition presenter 965, and a resistance level presenter 970. While the illustrated example depicts the second data set presenter 935 including specific presenters, other types of presenters may be included, such as a time duration presenter, a calorie presenter, an angle presenter, an exercise log presenter, another type of presenter, or combinations thereof.

The second data set presenter 940 may include a heart rate presenter 945, a calorie presenter 950, and a duration presenter 955. While the illustrated example depicts the third data set presenter 940 including specific presenters, other types of presenters may be included, such as a physiological condition presenter, a respiratory presenter, a blood pressure presenter, an upcoming exercise presenter, another type of presenter, or combinations thereof.

The treadmill 905 may be in communication with the sensors 980 and a display 985. The display 985 may be included in the treadmill, a mobile device, another type of device, or combinations thereof. Any appropriate type of sensor 980 may be in communication with the treadmill 905. A non-exhaustive list of sensors that may be in communication with the treadmill 905 include an odometer, a timer, a level, an accelerometer, a magnetometer, an altimeter, a gravity measure, a voltage detector, ohmmeter, a capacitor, an oximeter, a strain gauge, a camera, an optical sensor, a counter, another type of sensor, or combinations thereof. The sensors 980 may be incorporated into the treadmill, a wearable monitor, a device proximate the treadmill, or combinations thereof.

Figure 10:
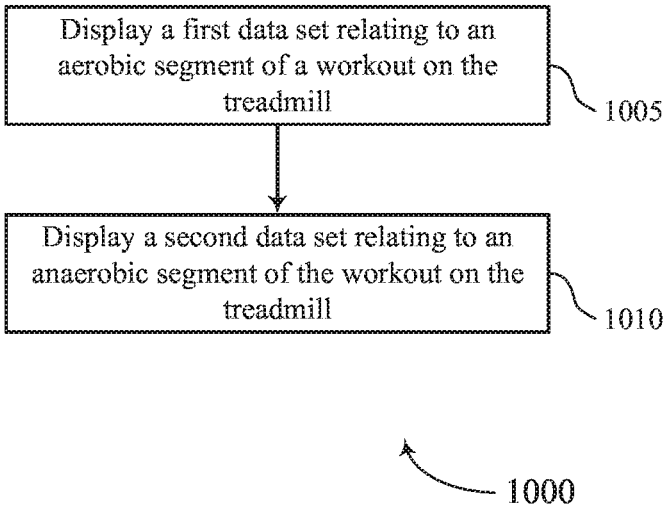
FIG. 10 depicts an example of a method for operating a treadmill in accordance with aspects of the present disclosure.

FIG. 10 shows a flowchart illustrating a method 1000 for displaying information in accordance with various aspects of the present disclosure. The operations of method 1000 may be implemented by a treadmill or its components as described herein. In some examples, a treadmill may execute a set of codes to control the functional elements of the device to perform the functions described below. Additionally or alternatively, the treadmill may perform aspects the functions described below using special-purpose hardware. At block 1005, the treadmill may display a first data set relating to an aerobic segment of a workout on the treadmill. At block 1010, the treadmill may display a second data set relating to an anaerobic segment of the workout on the treadmill.

Figure 11:
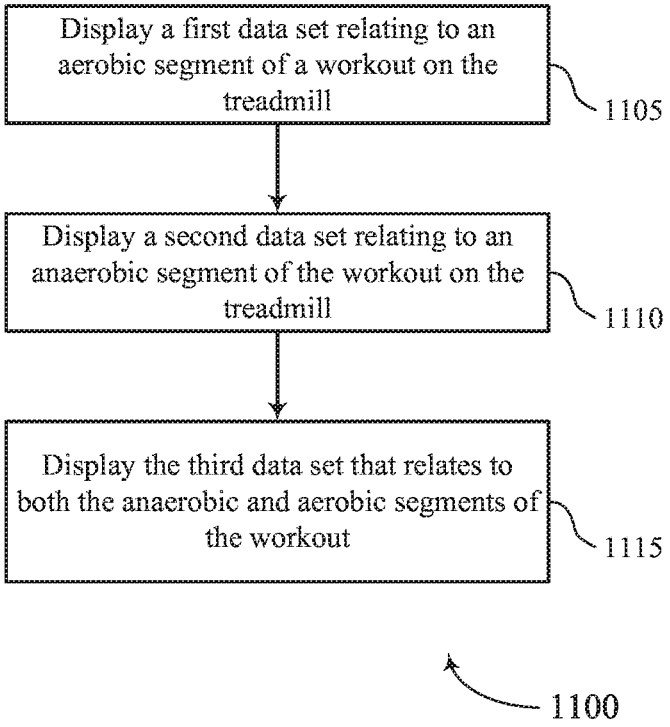
FIG. 11 depicts an example of a method for operating a treadmill in accordance with aspects of the present disclosure.

FIG. 11 shows a flowchart illustrating a method 1100 for displaying information in accordance with various aspects of the present disclosure. The operations of method 1100 may be implemented by a treadmill or its components as described herein. In some examples, a treadmill may execute a set of codes to control the functional elements of the device to perform the functions described below. Additionally or alternatively, the treadmill may perform aspects the functions described below using special-purpose hardware.

At block 1105, the treadmill may display a first data set relating to an aerobic segment of a workout on the treadmill. At block 1110, the treadmill may display a second data set relating to an anaerobic segment of the workout on the treadmill. At block 1115, the treadmill may display the third data set that relates to both the anaerobic and aerobic segments of the workout.

Figure 12:
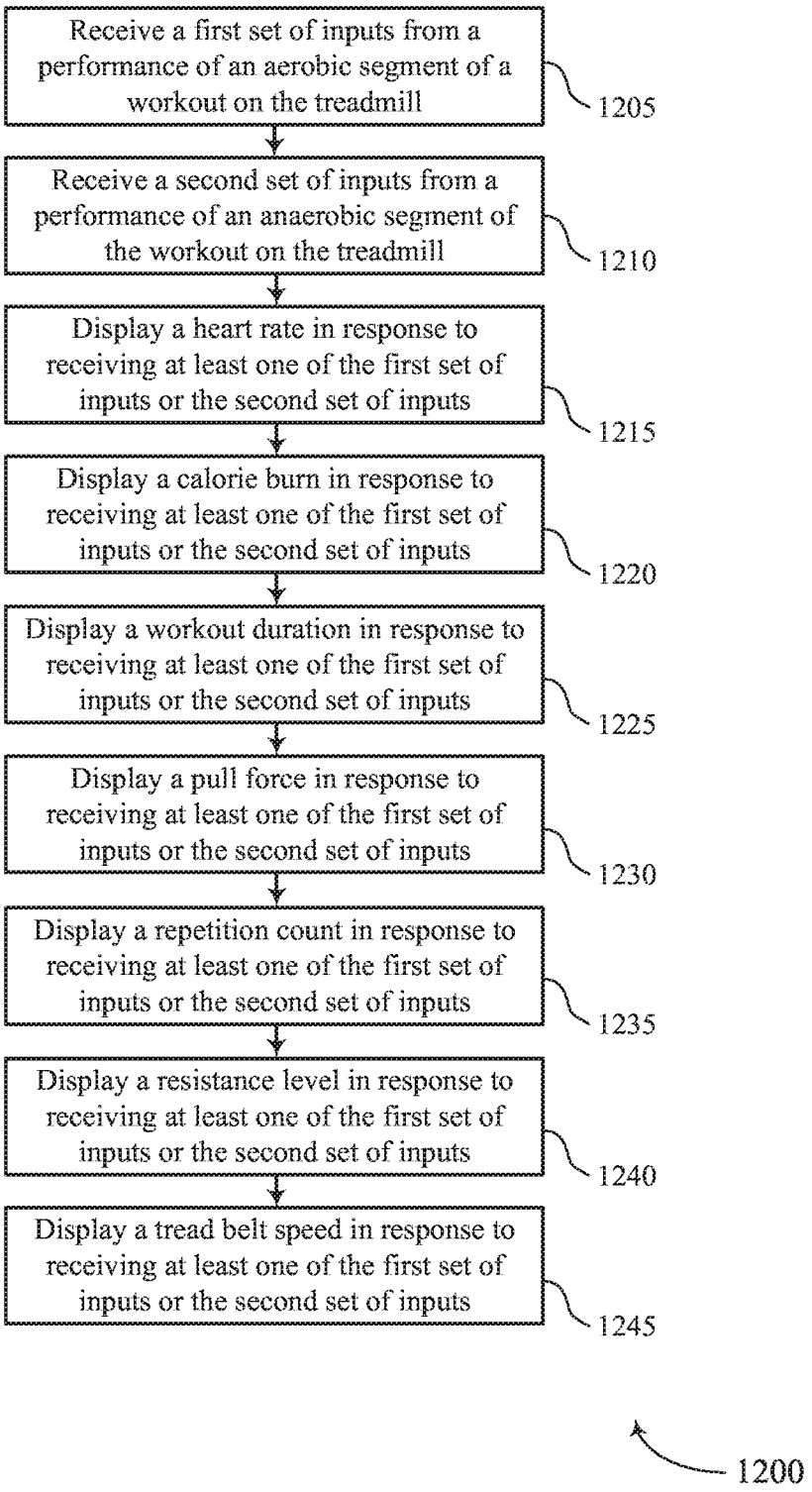
FIG. 12 depicts an example of a method for operating a treadmill in accordance with aspects of the present disclosure.

FIG. 12 shows a flowchart illustrating a method 1200 for displaying information in accordance with various aspects of the present disclosure. The operations of method 1200 may be implemented by a treadmill or its components as described herein. In some examples, a treadmill may execute a set of codes to control the functional elements of the device to perform the functions described below. Additionally or alternatively, the treadmill may perform aspects of the functions described below using special-purpose hardware. At block 1205, the treadmill may receive a first data set of inputs from a performance of an aerobic segment of a workout on the treadmill. At block 1210, the treadmill may receive a second set of inputs from a performance of an anaerobic segment of a workout on the treadmill. At block 1215, the treadmill may display a heart rate in response to receiving at least one of the first set of inputs or the second set of inputs. At block 1220, the treadmill may display a calorie burn in response to receiving at least one of the first set of inputs or the second set of inputs. At block 1225, the treadmill may display a workout duration in response to receiving at least one of the first set of inputs or the second set of inputs. At block 1230, the treadmill may display a pull force in response to receiving at least one of the first set of inputs or the second set of inputs. At block 1235, the treadmill may display a repetition count in response to receiving at least one of the first set of inputs or the second set of inputs. At block 1240, the treadmill may display a resistance level in response to receiving at least one of the first set of inputs or the second set of inputs. At block 1245, the treadmill may display a tread belt speed in response to receiving at least one of the first set of inputs or the second set of inputs.

GENERAL DESCRIPTION

In general, the invention disclosed herein may provide users with a treadmill that provides both a deck for performing an aerobic exercise and an upright structure that includes mechanisms for performing an anaerobic exercise. The user can stand on the deck while performing the anaerobic portion of the exercise. The mechanism for performing the anaerobic portion of the exercise may include a pull cable system that allows the user to perform a pull cable exercise while standing on the exercise deck.

In one example, the treadmill may include a deck, a first pulley, a second pulley, a tread belt, a locking mechanism, an upright structure, a pull cable, a handle, a resistance mechanism, a flywheel, a magnetic unit, a sensor, an input mechanism, a processor, a memory, a tread belt surface, an opening defined in the tread belt surface, a retractable pin, an inserting mechanism for inserting the pin in the opening, a motor, and a resistance mechanism.

The deck may include a first pulley disposed in a first portion of the deck, and a second pulley disposed in a second portion of the deck. The tread belt may surround the first pulley and the second pulley. In some cases, a motor is in mechanical communication with at least one of the first pulley and the second pulley. When the motor is active, the motor may cause the tread belt to move. In these types of examples, the user can control the speed of the tread belt through an input mechanism.

In other examples, the tread belt is driven by the user's power. In these types of examples, the vector force from the user's leg pushing against the length of the tread deck's surface causes the tread belt to move. A flywheel may be used to store inertia from the user driven movement of the tread belt. In these situations, the speed of the tread belt is controlled based on the effort inputted by the user's workout.

The locking mechanism may selectively prevent the tread belt from moving. In some cases, the locking mechanism is incorporated into a treadmill with a motor that drives movement of the treadmill. In other examples, the locking mechanism is incorporated into treadmills where the movement of the tread belt is moved by the user's walking/running power. In some examples, the locking mechanism may include a component that interlocks with the tread belt or a part the moves with the tread belt.

Any appropriate type of locking mechanism may be used in accordance with the principles described herein. In some cases, the locking mechanism is electronically operated. In other cases, the locking mechanism is manually operated. In one example, the locking mechanism applies a force directly to the tread belt to prevent movement. In other examples, the locking mechanism applies a force to at least one of the deck's pulley and/or an axle supporting the deck pulleys. In yet another example, the locking mechanism applies a force to a flywheel in mechanical communication with tread belt.

In one example, the tread belt includes a surface and a force is applied to the surface with the locking mechanism to prevent movement. The surface may include an area in a plane, and the force may be applied in a direction transverse the plane. This may be accomplished by applying a compressive force to the surface and applying an opposing force to an opposing side of the tread belt's surface. In some cases, the compressive force is applied at a single location such as along an edge of the tread belt. In other examples, the compressive force is applied to the tread belt at multiple locations such as along the edge and in regions that are centrally located to the tread belt.

In another example, the locking mechanism applies a force that has at least a vector component that is aligned with the plane of the surface's area. This may be accomplished by applying a pin, pins, or another type of object through the tread belt and thereby preventing the movement of the tread belt. In at least one of these types of examples, an opening may be defined in the surface of the tread belt. A retractable pin may be connected to the deck, and an inserting mechanism may be used to insert the retractable pin into the opening when the locking mechanism is active. The inserting force may be a magnetic force, a hydraulic force, a pneumatic force, a spring force, a mechanical force, another type of force, or combinations thereof.

An embodiment that includes a pin being inserted into an opening of the tread belt may not be feasible for slowing down a tread belt because the tread belt's momentum would be immediately arrested upon the insertion of the pin into the opening. The immediate stopping of the tread belt would result in a high load on the tread belt and the pin and would likely result in damage. Thus, the locking mechanism is advantageous because the locking mechanism may not have to arrest momentum of the tread belt when locking the tread belt in place.

In another example, a clamp is positioned adjacent to one of the deck's pulleys or a component that moves with the pulleys, such as the axle supporting the pulley. The clamp may apply a compressive force on the pulley and/or associated component to lock the tread belt in place. In other examples, the pulley, axle, or another component includes an opening, a flat, or a receptacle that can interlock with a component of the locking mechanism to lock the tread belt in place. As with the openings described above, interlocking a component of the locking mechanism with the pulley or associated component may not be feasible when the momentum of the tread belt has to be arrested when locking the tread belt in place.

In another example, a magnetic unit may be applied to at least one of the pulleys, the axle supporting the pulleys, a flywheel in communication with the pulleys, another component that moves with the pulleys, or combinations thereof. The magnetic unit may be used to apply a magnetic force strong enough to ensure that the tread belt cannot move. In one particular example, a flywheel stores the inertia of a user powered tread belt, and a magnetic unit prevents the movement of the tread belt by imposing a magnetic force on the flywheel.

The locking mechanism may be applied in response to any appropriate trigger. In some examples, the locking mechanism is applied in response to the user activating the locking mechanism. This may be accomplished with an input mechanism incorporated into the treadmill or another device in communication with the treadmill. For example, the input mechanism may be a push button, a touch screen, a microphone, a lever, a switch, a dial, another type of input mechanism, or combinations thereof. In other examples, the input mechanism may include manually inserting a pin, manually inserting an interlocking component, or manually applying a compressive force.

In examples where the treadmill is configured to support an anaerobic exercise, the locking mechanism may be triggered in response to the movement of a component associated with the anaerobic exercise. In one example, the locking mechanism is triggered in response to movement of a pull cable, in response to a rotation of a flywheel of a resistance mechanism, a movable weight is lifted, an increased force is applied to the deck (e.g. indicting the acceleration of a free weight or other type of lift exercise), another trigger, or combinations thereof. In some cases, the locking mechanism locks the tread belt from moving when the pull cable is being pulled. In some cases, the locking mechanism locks the tread belt in response to a pull force on the pull cable.

In another example, the locking mechanism is triggered in the absence of a force. For example, the locking mechanism may prevents the tread belt from moving when the motor is inactive.

In some examples, an upright structure is connected to the base. In this example, the upright structure includes a first arm and a second arm extending away from a central portion of the upright structure. The first arm supports a first cable, and the second arm supports a second cable. The first and second cables each have an end that is attached to a handle. The other end of the first and second cables are attached to a resistance mechanism that is connected to the upright structure. A display is also attached to the upright structure which displays information about the user's workout involving the movement of the tread belt. In this example, the resistance mechanism includes a flywheel, and the rotation of the flywheel is resisted with a magnetic unit.

The spool may be connected to the axle so that the axle moves when the spool rotates in a first direction with the pulling force on the cable. As the user reduces the pull force, a counterweight or another type of winding mechanism may cause the spool to rotate in a second direction to wind the pull cable back around the spool. In the depicted example, the spool is connected to the axle so that when the spool rotates in a second direction, the axle does not rotate with the spool. Thus, in the second direction, the spool rotates independently of the axle. Thus, when the pull cable moves along its length in the second direction, the flywheel does not rotate with the pull cable.

With the flywheel rotating in a single direction, the determination of multiple parameters of the user's workout can be simplified. For example, a sensor positioned adjacent to the flywheel may detect the movement of the flywheel by counting the number of rotations or partial rotations of the flywheel. Counting may be accomplished in examples where the magnet, marker, ticker, or other indicator passes by the sensor. Each repetition of a pull exercise may correspond to a predetermined number of counts. Thus, the repetitions may be tracked by the rotation of the flywheel. Further, the time duration between the counts may also indicate the speed at which the user is pulling on the pull cable, which can correspond to the force that the user is applying to the pull exercise. The force can also be determined by factoring the resistance level that the magnetic unit is applying to the flywheel.

While this example has been described with reference to the flywheel rotating in just a single direction, in alternative embodiments, the flywheel rotates with the movement of the pull cable in both directions.

In some examples, the magnetic unit is positioned adjacent to a periphery of the flywheel. The magnetic unit may impose a magnetic force on the flywheel that resists the flywheel's rotation. In some cases, the strength of the magnetic unit's resistance may be increased by moving the magnetic unit closer to the flywheel. Conversely, in the same example, the strength of the resistance may be lowered by moving the magnetic unit farther away from the flywheel. In an alternative example, the strength of the magnetic unit may be altered by changing an electrical power level to the magnetic unit. Also disposed on the axle is a spool where the second end of the pull cable connects to the resistance mechanism. As the pull cable is pulled from the first end, the second end of the cable moves causing the spool to rotate.

The treadmill may include a display. The display may be incorporated into a console of the treadmill, into an upright portion of the treadmill, into the deck of the treadmill, into a rail of the treadmill, into another portion of the treadmill, into a device in electronic communication with the treadmill, or combinations thereof. In this example, the display may have fields for presenting a number of pull cable sets, a number of pull cable repetitions, an average pull force on the cable, a resistance level, an anaerobic calorie burn, an aerobic calorie burn, a heart current rate, and a running time duration, respiratory rate, a blood pressure rate, another type of physiological parameter, another type of operational treadmill parameter, or combinations thereof. Thus, the display may depict exercise parameters from exercises involving the movement of the tread belt and exercises involving movement of another component independent of the tread belt's movement. The display may depict exercise parameters from exercises involving the movement aerobic exercises and anaerobic exercises. Further, the display may present physiological information that is independently derived from the movement of the tread belt and exercises involving movement of another component independent of the tread belt's movement and/or independently from exercises involving the movement aerobic exercises and anaerobic exercises. In other examples, the physiological parameters are derived from a combination the different exercise types.

The presenters described above may include a combination of hardware and programmed instructions to implement that functions assigned to each of the presenters. For example, the heart rate presenter may be in communication with a heart rate monitor, which may be part of a wearable device or a heart rate monitor integrated into the treadmill. The heart rate presenter may obtain periodic information from the heart rate monitor about the user's heart rate. This information may be received by the heart rate presented without request. In alternative embodiments, the heart rate presenter requests information from the heart rate monitor. In some cases, the raw data from the heart rate monitor is caused to be processed by the heart presenter. In alternative embodiments, the heart rate monitor processes at least a portion of the information. The heart rate presenter sends the heart rate information to the display for presentation to the user. While these examples have been described with reference to the heart rate presenter, the principles, arrangements, and relationships described above with the sensor, display, processor, memory, and presenter may be generally applied to each of the presenters incorporated into the treadmill.

The display of the current disclosure may display a wide range of information that is not found in conventional treadmills, which provide an option of performing just aerobic type exercises. In the examples described in the present disclosure, the display includes information from the aerobic segments of the workout as well as information relating to anaerobic portions of the workout.

In this example, the treadmill may track the user's number of calories burned. The inputs for the calorie burn may be obtained from the aerobic segments of the workout such as the time duration of an aerobic workout, the heart rate of the user, the speed of the treadmill, the user's weight, other parameters of the aerobic workout, or combinations thereof. Further, the presented calorie burn may be based in part on the anaerobic segments of the workout such as the amount of weight lifted by the user, the number of sets and repetitions performed by the user, the force at which the user executed the pull, the heart rate before and after the pull, the time duration between performing the pull and the completing an aerobic portion of the workout, other factors, or combinations thereof. The factors from both the aerobic and anaerobic portions of the workout may be collectively used to determine the user's calorie burn.

Further, the physiological parameters of the user may be tracked during both the aerobic portions and the anaerobic portions of the workout. Conventionally, a treadmill tracks just the physiological parameters during the aerobic portion of the workout. As a result, the user is unaware if the user is exceeding a desired heart range, a blood pressure range, a respiratory rate range, another type of physiological condition range during the anaerobic portions of the workout. Thus, with the treadmill described in the present invention, the user can monitor his or her health during additional portions of his or her workout.

In some examples, a hand rail is connected to the upright structure. The hand rail includes a first post connected to a first side, and a second post connected to a second side. Each of the first and second posts are pivotally connected to the upright structure.

The deck may be connected to the upright structure at a base pivot connection. As the deck is rotated upwards, the deck engages the handrail before arriving at the deck's storage position. As the deck continues to move upward after engaging the handrail, the posts of the handrail rotate about the post pivot connections. Thus, as the deck continues to move upward, the deck and the handrail move upward together. When the deck arrives at the storage position, a latch may be used to hold the rear end of the deck in the storage position. Thus, the deck and the handrail are held in an upward, storage position with a single latch.

The different functions of the treadmill may be implemented with a processor and programmed instructions in memory. In some examples, the certain aspects of the pull cable system's and/or the locking mechanism's functions are executed with a customized circuit. Additionally, the different functions of the exercise machine may be implemented with a processor and programmed instructions in memory. In some examples, certain aspects of the exercise machine's functions are executed with a customized circuit.

The processors may include an intelligent hardware device, (e.g., a general-purpose processor, a digital signal processor (DSP), a central processing unit (CPU), a microcontroller, an application specific integrated circuit (ASIC), a field-programmable gate array (FPGA), a programmable logic device, a discrete gate or transistor logic component, a discrete hardware component, or any combination thereof). In some cases, the processors may be configured to operate a memory array using a memory controller. In other cases, a memory controller may be integrated into the processor. The processor may be configured to execute computer-readable instructions stored in a memory to perform various functions (e.g., function or tasks supporting overlaying exercise information on a remote display).

An I/O controller may manage input and output signals for the media system and/or the exercise machine. Input/output control components may also manage peripherals not integrated into these devices. In some cases, the input/output control component may represent a physical connection or port to an external peripheral. In some cases, I/O controller may utilize an operating system such as iOS®, ANDROID®, MS-DOS®, MS-WINDOWS®, OS/2®, UNIX®, LINUX®, or another known operating system.

Memory may include random access memory (RAM) and read only memory (ROM). The memory may store computer-readable, computer-executable software including instructions that, when executed, cause the processor to perform various functions described herein. In some cases, the memory can contain, among other things, a Basic Input-Output system (BIOS) which may control basic hardware and/or software operation such as the interaction with peripheral components or devices.

The treadmill may be in communication with a remote that stores and/or tracks fitness data about a user. An example of a program that may be compatible with the principles described herein includes the iFit program which is available through www.ifit.com. Such profile information may be available to the user through an iFit program available through www.ifit.com and administered through ICON Health and Fitness, Inc. located in Logan, Utah, U.S.A. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof. The user information may also be gather through profile resources may be available through other types of programs. For example, the user's information may be gleaned from social media websites, blogs, public databases, private databases, other sources, or combinations thereof. In yet other examples, the user information may be accessible through the exercise machine. In such an example, the user may input the personal information into the exercise machine before, after, or during the workout. The user's information along with historical exercise data of the user may be used to provide the user with a range of physiological parameters that are healthy for the user. Further, this information may be used to make workout recommendations and derive user goals. Also, this type of information may be useful for presenting the user's progress.

It should be noted that the methods described above describe possible implementations, and that the operations and the steps may be rearranged or otherwise modified and that other implementations are possible. Furthermore, aspects from two or more of the methods may be combined.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and modules described in connection with the disclosure herein may be implemented or performed with a general-purpose processor, a DSP, an ASIC, a FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a digital signal processor (DSP) and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media can include RAM, ROM, electrically erasable programmable read only memory (EEPROM), compact disk (CD) ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. In some cases, the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, digital subscriber line (DSL), or wireless technologies such as infrared, radio, and microwave are included in the definition of medium. A portable medium, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. A treadmill, comprising:

a deck;

a first pulley disposed in a first portion of the deck;

a second pulley disposed in a second portion of the deck;

a tread belt surrounding the first pulley and the second pulley;

an upright structure connected to the deck;

a pull cable incorporated into the upright structure;

a handle connected to a first end of the pull cable; and a resistance mechanism connected to a second end of the pull cable, the resistance mechanism including a flywheel incorporated into the upright structure and a magnetic unit disposed on the upright structure that is configured to selectively apply a resistance to a rotation of the flywheel, the flywheel being in selective mechanical communication with the pull cable and the tread belt.

2. The treadmill of claim 1, further comprising a sensor on the upright structure configured to detect movement of the flywheel.

3. The treadmill of claim 1, further comprising:

a console incorporated into the upright structure; and a display incorporated into the console.

4. The treadmill of claim 3, further comprising:

a processor; and memory having programmed instructions that, when executed, cause the processor to present, on the display exercise information about a workout performed on the treadmill.

5. The treadmill of claim 4, wherein the programmed instructions, when executed, further cause the processor to:

present, on the display, an aerobic data set derived from the rotation of the flywheel; and present, on the display separately from the displaying of the aerobic data set, an anaerobic data set derived from movement of the tread belt.

6. The treadmill of claim 1, further comprising a first pivot connection between the deck and the upright structure;

wherein the first pivot connection allows the deck to rotate upwards towards the upright structure into a storage orientation.

7. The treadmill of claim 6, further comprising:

a support rail; and a second pivot connection attaching the support rail to the upright structure.

8. The treadmill of claim 7, wherein the deck is configured to push the support rail up into an upright orientation about the second pivot connection when the deck is the storage orientation.

9. The treadmill of claim 8, further comprising a latch connected to the upright structure configured to simultaneously hold the deck in the storage orientation and the support rail in the upright orientation.

10. The treadmill of claim 7, wherein the support rail is transversely oriented with respect to a length of the deck.

11. A treadmill, comprising:

a deck;

a first pulley disposed in a first portion of the deck;

a second pulley disposed in a second portion of the deck;

a tread belt surrounding the first pulley and the second pulley;

an upright structure connected to the deck;

a pull cable incorporated into the upright structure;

a display;

a processor;

memory in electronic communication with the processor; and instructions stored in the memory and operable, when executed, to cause the processor to:

derive a first set of data from movement of the tread belt during a workout on the treadmill;

present on the display the first data set;

derive a second set of data from rotation of a flywheel, incorporated into the treadmill and connected to the pull cable, during the workout on the treadmill; and present on the display a second data set separately from the presenting of the first data set.

12. The treadmill of claim 11, wherein the instructions are further executable by the processor to present on the display a third data set derived from a combination of the first data and the second data.

13. The treadmill of claim 12, wherein the third data set relates to a physiological condition of a user during the workout.

14. The treadmill of claim 11, wherein the second data set includes a pull force.

15. The treadmill of claim 11, wherein the second data set includes a repetition count.

16. A treadmill, comprising:

a deck;

a first pulley disposed in a first portion of the deck;

a second pulley disposed in a second portion of the deck;

a tread belt surrounding the first pulley and the second pulley;

an upright structure pivotally connected to the deck;

a pull cable incorporated into the upright structure;

a handle connected to a first end of the pull cable;

a resistance mechanism including a flywheel connected to a second end of the pull cable, the flywheel being incorporated into the upright structure;

a magnetic unit on the upright structure configured to apply a resistance to a rotation of the flywheel;

a support rail;

a second pivot connection attaching the support rail to the upright structure where the deck is configured to push the support rail up into an upright orientation about the second pivot connection when the deck is in a storage orientation;

a processor; and memory having programmed instructions that, when executed, cause the processor to:

display a first data set relating to an aerobic segment of a workout performed on the treadmill; and display a second data set relating to an anaerobic segment of the workout performed on the treadmill.

17. The treadmill of claim 16, wherein the instructions, when executed, further cause the processor to display a third data set derived from a combination of the aerobic segment and the anaerobic segment, the third data set relating to a physiological condition of a user during the workout.

18. The treadmill of claim 16, wherein:

the first data set includes the calories burned during the performance of the workout by walking and/or running on the tread belt; and the second data set includes the calories burned during the performance of the workout by pulling on the pull cable.

19. The treadmill of claim 11, wherein:

the first data set includes the calories burned during the performance of the workout by walking and/or running on the tread belt; and the second data set includes the calories burned during the performance of the workout by pulling on the pull cable.

* * * * *